US008186194B2

(12) United States Patent
Field et al.

(10) Patent No.: US 8,186,194 B2
(45) Date of Patent: May 29, 2012

(54) CYLINDER LOCK AND AUXILIARY LOCKING MECHANISM

(75) Inventors: Peter H. Field, Salem, VA (US); David P. Sutherland, Roanoke, VA (US); Glenn Hartman, Salem, VA (US); Mark Benzie, Roanoke, VA (US); Walt Dannhardt, Roanoke, VA (US); Kevin Galliher, Roanoke, VA (US); Dan Boadwine, Salem, VA (US); Clyde T. Roberson, Salem, VA (US)

(73) Assignee: Medeco Security Locks, Inc., Salem, VA (US)

( * ) Notice: Subject to any disclaimer, the term of this patent is extended or adjusted under 35 U.S.C. 154(b) by 330 days.

(21) Appl. No.: 12/413,139

(22) Filed: Mar. 27, 2009

(65) Prior Publication Data

US 2009/0241620 A1 Oct. 1, 2009

Related U.S. Application Data

(60) Provisional application No. 61/039,864, filed on Mar. 27, 2008.

(51) Int. Cl.
*E05B 27/00* (2006.01)
*E05B 29/00* (2006.01)

(52) U.S. Cl. ..... 70/491; 70/409; 70/421; 70/419; 70/496; 70/493; 70/495

(58) Field of Classification Search ..... 70/409, 70/421, 491, 496, 493, 495, 419
See application file for complete search history.

(56) References Cited

U.S. PATENT DOCUMENTS

| | | | | |
|---|---|---|---|---|
| 1,036,764 | A | 8/1912 | Wilson | |
| 1,141,215 | A | 6/1915 | Sohm | |
| 1,173,677 | A | 2/1916 | Muller | |
| 1,375,521 | A | 4/1921 | Lasky | |
| 2,000,829 | A | 5/1935 | Falk | |
| 2,036,747 | A * | 4/1936 | Fitz Gerald | 70/496 |
| 2,064,955 | A | 12/1936 | Singer et al. | |
| 2,215,162 | A | 9/1940 | Scott | |
| 2,391,834 | A | 12/1945 | Johnstone | |
| 2,690,070 | A | 9/1954 | Spain | |
| 2,982,121 | A | 5/1961 | George | |
| 3,078,706 | A | 2/1963 | Russell | |
| 3,267,707 | A | 8/1966 | Adams | |

(Continued)

FOREIGN PATENT DOCUMENTS

DE 2828343 A1 1/1980

(Continued)

OTHER PUBLICATIONS

International Search Report and Written Opinion mailed Jul. 14, 2009, 15 pages, on international application PCT/US2009/038606.

(Continued)

*Primary Examiner* — Lloyd Gall
*Assistant Examiner* — David E Sosnowski
(74) *Attorney, Agent, or Firm* — Rothwell, Figg, Ernst & Manbeck, PC

(57) ABSTRACT

A tumbler pin lock includes an auxiliary locking mechanism including an auxiliary locking pin to provide enhance locking in addition to the locking provided by the tumbler pins so that the lock remains locked even if the tumblers are picked or bumped into their unlocked positions.

13 Claims, 21 Drawing Sheets

U.S. PATENT DOCUMENTS

| | | | | | |
|---|---|---|---|---|---|
| 3,298,211 | A | | 1/1967 | Russell et al. | |
| 3,320,782 | A | | 5/1967 | Turman | |
| 3,425,248 | A | * | 2/1969 | Duval | 70/421 |
| 3,492,843 | A | | 2/1970 | Schieber et al. | |
| 3,499,302 | A | | 3/1970 | Spain et al. | |
| 3,541,819 | A | | 11/1970 | Kerr | |
| 3,597,948 | A | | 8/1971 | Johnstone | |
| 3,670,540 | A | | 6/1972 | Fernandez | |
| 4,012,931 | A | * | 3/1977 | Harunari | 70/496 |
| 4,114,411 | A | | 9/1978 | Schlage | |
| 4,196,604 | A | | 4/1980 | Vorob | |
| 4,221,121 | A | | 9/1980 | Tietz | |
| 4,328,692 | A | | 5/1982 | Dice et al. | |
| 4,356,713 | A | | 11/1982 | Widen | |
| RE31,791 | E | * | 1/1985 | Dice, Sr. | 70/421 |
| 4,635,455 | A | | 1/1987 | Oliver | |
| 5,088,306 | A | | 2/1992 | Field | |
| 5,209,087 | A | | 5/1993 | Cox | |
| 5,615,566 | A | | 4/1997 | Brandt | |
| 5,778,712 | A | | 7/1998 | Walldén | |
| 6,079,240 | A | | 6/2000 | Shvarts | |
| 6,301,942 | B1 | * | 10/2001 | Shvarts | 70/409 |
| 6,477,875 | B2 | * | 11/2002 | Field et al. | 70/491 |
| 6,526,791 | B2 | | 3/2003 | Shvarts | |
| 6,708,539 | B1 | * | 3/2004 | Widen | 70/371 |
| 6,718,807 | B2 | | 4/2004 | Andersson | |
| 6,945,082 | B2 | | 9/2005 | Field et al. | |
| 7,475,579 | B2 | * | 1/2009 | Miao | 70/496 |
| 7,681,425 | B2 | | 3/2010 | Teixeira | |
| 7,685,854 | B2 | * | 3/2010 | Xu et al. | 70/491 |
| 2006/0096344 | A1 | * | 5/2006 | Lee | 70/491 |
| 2007/0137272 | A1 | | 6/2007 | Field et al. | |

FOREIGN PATENT DOCUMENTS

| | | | |
|---|---|---|---|
| DE | 3424336 | A1 | 1/1985 |
| DE | 3603687 | A1 | 8/1987 |
| DE | 29708308 | U1 | 8/1997 |
| DE | 19939734 | A1 | 5/2001 |
| EP | 0237172 | | 3/1987 |
| EP | 0237172 | A2 | 9/1987 |
| FR | 2388966 | | 11/1978 |

OTHER PUBLICATIONS

International Preliminary Report on Patentability for PCT/US2009/038606, 15 pgs. (Jun. 8, 2010).

* cited by examiner

CYLINDER LOCK AND AUXILIARY LOCKING MECHANISM

This application claims the benefit under 35 U.S.C. 119(e) of U.S. Provisional Application Ser. No. 61/039,864, filed Mar. 27, 2008, the disclosure of which is hereby incorporated by reference.

BACKGROUND OF THE INVENTION

1. Field of the Invention

This invention relates to cylinder locks and particularly to pin tumbler cylinder locks with axial sliding detainers that provide a secondary locking mechanism in the cylinders.

2. Discussion of the Background

An ongoing problem for people using locks is other people trying to pick these locks. Pin tumbler locks, a traditional type of lock, are so common that one can buy tools specifically designed to pick a pin tumbler lock. At the same time, pin tumbler technology is well known, and consumers are comfortable with pin tumbler keys. As described below, many have looked to develop an improved lock that is less susceptible to lock picking.

A. Sohm in U.S. Pat. No. 1,141,215 discloses a cylinder where the plug contains moveable wards, or sliders, that are pushed axially by the insertion of the key. The sliders have a key contact surface and a projecting blade that extends into the shell. The shell contains annular grooves that will accept the projecting blade when the sliders are correctly positioned by the key. When the blades are positioned within the annular grooves, the plug is free to turn.

The moveable wards or sliders of this invention are primary locking elements in the cylinder. They also directly block the rotation of the plug within the shell.

B. Perkut in German Pat. No. DE 2 828 343 teaches two locking concepts. The first one (see FIG. 5) is of a moveable ward or slider that is very similar to the Sohm patent, but is used as a secondary locking mechanism in a pin tumbler cylinder. The slider 12' has a blade 34 that extends into the shell and must be pushed by the key to an unlocked position, whereupon the blade is located in an annular ring 38 in the shell. This slider directly blocks the rotation of the plug within the shell.

The second locking concept (see FIGS. 1-4) also uses the slider as an auxiliary locking mechanism. The slider 12, interfaces with a ball 20 that extends from the plug into the shell and blocks the rotation of the plug. The slider has a cavity 18 that will accept the ball when the slider is pushed to a correct axial position. When both the primary tumbler pins 106*a* and 106*b* and the slider are correctly aligned, the rotation of the plug forces the ball out of the shell into the plug and into the cavity 18 in the slider. Thus the plug can rotate freely. This slider provides an intermediary member, the ball, to block the rotation of the plug within the shell. However the curved shape of a ball will allow the plug to turn even if the slider is not precisely positioned.

G. Brandt in U.S. Pat. No. 5,615,566 also discloses a cylinder where the plug contains an auxiliary locking element, or slider, in addition to the regular pin tumblers. The Brandt slider 16 has a projecting blade 54 that extends out the back side of the plug and fits into a notch 24 in the shell. When the slider is pushed to the rear-most position by the insertion of the key, the slider is pushed out of the notch in the shell, and if the tumbler pins are also correctly aligned, the plug is free to rotate. The slider directly blocks the plug from rotating within the shell.

P. Field et al. in U.S. Pat. No. 6,477,875 discloses a cylinder where the plug contains sliders 24 or 24' that move axially and provide tertiary locking mechanisms in the cylinder. The rotating pins must be correctly elevated for the shear line and also be rotationally aligned for the sidebar mechanism 16 or 16' before the cylinder will unlock. Additionally, the sliders in the Field invention have projecting blades 32 or 32' that are used to block the sidebar mechanism. The slider must be positioned at the correct axial location before the sidebar can contact the rotating pins. This slider blocks the motion of the sidebar in the plug.

Additional detailed specifications of a sidebar cylinder with a P. Field et al. slider and the key interface is provided in U.S. Pat. No. 6,945,082.

B. Field et al. in U.S. Pat. Application Publication 2007/0137272 teaches a cylinder that contains a sidebar 18 that is axially positioned by the side of a key. When moved to the correct position, the ends of the sidebar are at a location to allow the sidebar to cam into the plug and contact the side of the keyblade. If the key blade is configured with a shape corresponding to the edge of the sidebar 36, the sidebar can move and allow the plug to rotate. The sliding sidebar directly blocks rotation of the plug in the shell.

The inventor has found that these lock designs have room for improvement. In particular, these additional mechanisms require valuable space within a traditional pin and tumbler design, and thus require that locks incorporating these features must be large or, alternatively, if a large lock is not possible, these features must be foregone.

SUMMARY OF THE INVENTION

It is an object of this invention to provide a secondary locking mechanism within a cylinder whereby the primary tumbler pins are left unchanged and the secondary mechanism will provide for additional master keying levels without changing the key hole in the cylinder.

It is desirable to reduce the size and configuration of the components in a cylinder with an auxiliary slider mechanism, so that the mechanism can be used to key together, in the same key system, cylinders of various sizes and shapes.

It is desirable to provide a new smaller secondary locking mechanism in a cylinder, so that the key that will operate a slider and sidebar cylinder will also operate in a cylinder without space to accommodate a sidebar mechanism, thus providing expanded keying systems.

Aspects of the invention are embodied in a lock comprising a cylindrical plug having an axially-extending keyway adapted to receive a conforming key, a plurality of tumbler pins, an auxiliary locking pin, and a slider. The tumbler pins are disposed within radially-oriented tumbler pin holes formed in the cylindrical plug and adapted to control rotation of the cylindrical plug and are constructed and arranged to be engaged by a properly configured key inserted into the keyway and to be positioned by the key within their respective tumbler pin holes so as to permit the cylindrical plug to rotate. The auxiliary locking pin is disposed within the cylindrical plug and is moveable between a first position in which a portion of the auxiliary locking pin extends out of a hole formed in an outer wall of the cylindrical plug and a second position in which the auxiliary locking pin is retracted into the hole. The slider is disposed within the cylindrical plug and is moveable in an axial direction between a first position and a second position. The slider is constructed and arranged to be engaged by a cooperating key inserted into the keyway to move the slider from the first position to the second position, and the slider is operatively inter-engaged with the auxiliary locking pin such that the auxiliary locking pin is in its first position when the slider is in its first position and the auxiliary locking pin moves from its first position to its second position when the slider is moved from its first position to its second position.

Further aspects of the invention are embodied in a lock comprising a cylindrical plug having an axially-extending keyway adapted to receive a conforming key, a plurality of tumbler pins, and an auxiliary locking pin. The tumbler pins are disposed within radially-oriented tumbler pin holes formed in the cylindrical plug and adapted to control rotation of the cylindrical plug and are constructed and arranged to be engaged by a properly configured key inserted into the keyway and to be positioned by the key within their respective tumbler pin holes so as to permit the cylindrical plug to rotate. The auxiliary locking pin is disposed within the cylindrical plug and is moveable between a first position in which a portion of the auxiliary locking pin extends out of a hole formed in an outer wall of the cylindrical plug and a second position in which the auxiliary locking pin is retracted into the hole. The auxiliary locking pin includes a key contact projection extending into the keyway and constructed and arranged to be engaged by a conforming key to move the auxiliary locking pin from its first position to its second position as the conforming key is inserted into the keyway.

These and other features, aspects, and advantages of the present invention will become apparent to those skilled in the art after considering the following detailed description, appended claims and accompanying drawings.

DETAILED DESCRIPTION

Figure 1:
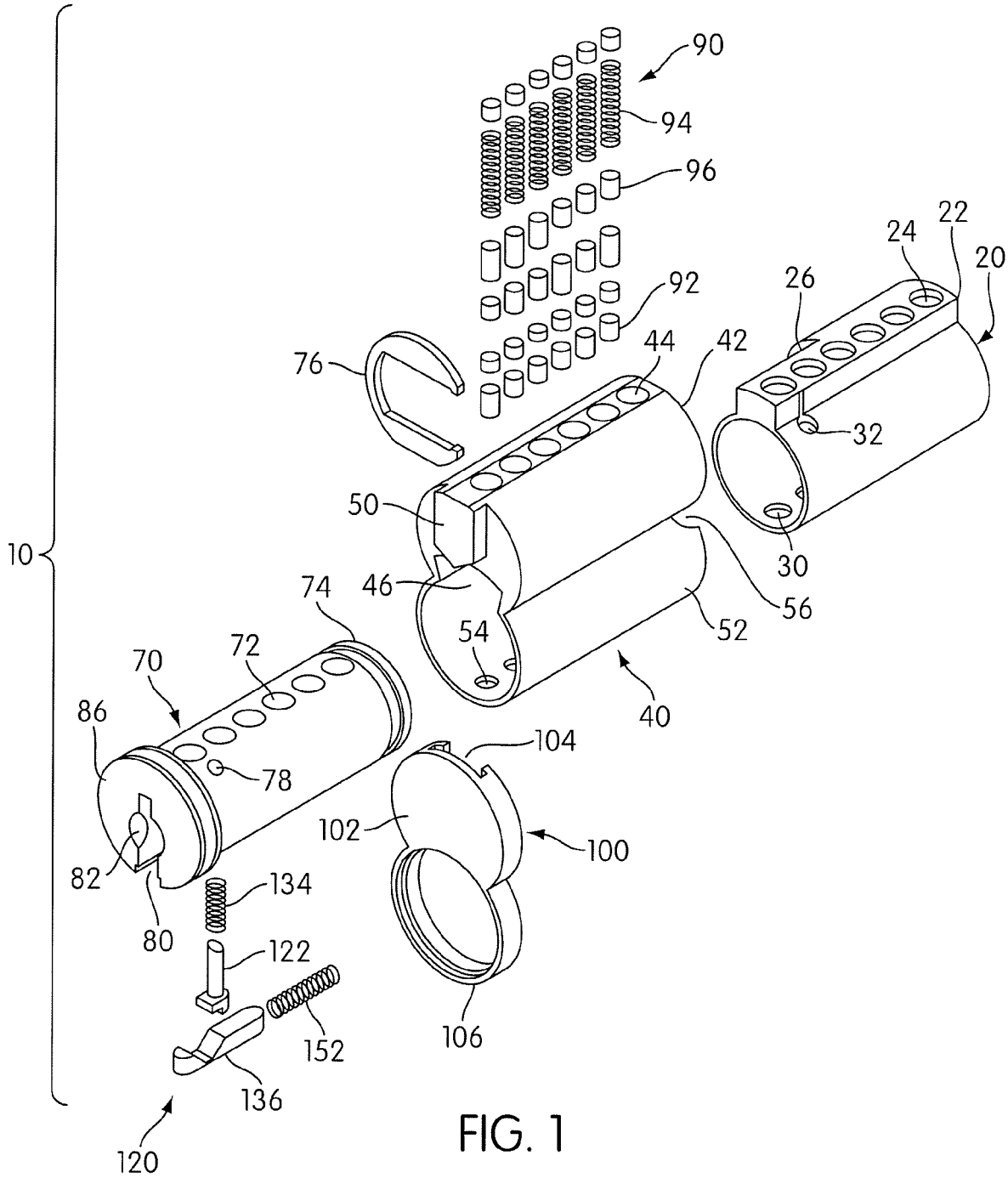
FIG. 1 is an exploded perspective view of a cylinder lock with an auxiliary locking mechanism according to one embodiment.

FIG. 1 illustrates an exploded view of a cylinder lock 10 according to one embodiment of the invention. Cylinder lock 10 includes a cylindrical plug 70, a control sleeve 20, a shell 40, a faceplate 100, and an auxiliary locking mechanism 120 The cylinder lock 10 shown in FIG. 1 is of the type known as a small format interchangeable core cylinder. This is for the sole purpose of illustrating an embodiment of the inventive lock incorporating an auxiliary locking mechanism and is not intended to be limiting, as the auxiliary locking mechanism could be incorporated into other locks as well.

The shell 40 includes an upper section 42 and a lower section 52. Lower section 52 has a hollow, generally cylindrical configuration. The upper section 42 has a solid, generally cylindrical configuration and includes tumbler pin holes 44 which receive conventional tumbler pins 90 (i.e., pin stacks). Upper section 42 includes a recess 46 extending along the axial length of the shell 40 along the bottom of the upper section 42. The shell 40 further includes a flanged protrusion 50, configured to interlock with recessed portion 104 (e.g., a dovetail slot) formed in the faceplate 100. The lower section 52 of the shell 40 is hollow to receive the control sleeve 20 and the plug 70. Service holes 54 formed in the bottom of the lower section 52 of the shell 40 allow a locksmith to remove tumblers from the tumbler holes 44 to re-key the lock 10. A cutaway section 56 is formed in the rear of the lower section 52 of the shell 40.

The control sleeve 20 is housed inside the shell 40. Control sleeve 20 has a hollow, cylindrical configuration with a raised portion 22. Tumbler holes 24 formed in the raised portion 22 of the control sleeve 20 align with tumbler holes 44 formed in the shell 40 when the control sleeve 20 is inserted into the shell 40, such that tumblers 90 inside may move up and down to control rotation of the plug 70 in a conventional manner. Service holes 30 formed in the bottom of the control sleeve 20 align with service holes 54 formed in the shell 40. The control sleeve 20 includes a control lug 26 along part of one side of the raised portion 22. Raised portion 22 of the control sleeve 20 is received within the recess 46 formed in the upper section 42 of the shell 40, and control lug 26 interlocks with the bottom of the upper section 42 of the shell 40 to lock the control sleeve 20 within the shell 40. The control sleeve 20 further includes an auxiliary locking pin hole 32.

The faceplate 100 includes a guard 102 with a recess 104 (e.g., a dovetail slot) which mates with the flanged protrusion 50 of the shell 40 and a ring 106 which rests against the opening of the lower section 52 of the shell 40.

The plug 70 is mounted for axial rotation within the control sleeve 20, which is disposed within the lower section 52 of the shell 40. Tumbler holes 72 are formed in the plug 70 and communicate with a keyway 80 formed axially into the plug 70. Plug 70 further includes an auxiliary locking pin hole 78. Tumblers 90 disposed within the tumbler holes 72 operate along with a key in a conventional manner to control rotation of the plug 70. This rotating action is generally used to release a latching mechanism (not shown). A retainer groove 74 formed in the rear end of the plug 70 receives a retainer clip 76 for securing the plug 70 within the sleeve 20 and shell 40.

Pin stacks 90 of various bottom pins 92, master wafers, top pins 96, and springs 94 are positioned in the tumbler holes 72, 24, and 44. Arrangements of spring loaded pins provide master keying capability and are well known in the lock art.

The head 86 of the plug 70 has a stepped perimeter which mates with the ring 106 on the faceplate 100. The head 86 of the plug 70 provides the entry to a keyway 80. The entry has formed keyway guides 82 which extend across the face of the entry. These guides, formed by the depressions, may be useful in guiding a key (shown later) into the keyway 80 by redirecting the force of the oncoming key along the face of the depression such that the key is aligned with the keyway 80.

The cylinder plug 70 of the small format interchangeable core cylinder shown includes two longitudinally extending blind bores 88 (see FIGS. 2, 4 and 9) bored parallel to the keyway 80 from the rear portion of the barrel of the cylinder plug 70. One bore 88 is formed on each side of the keyway 80, and the two bores 88 engage with corresponding prongs of a tailpiece (not shown), all of which are rotatably disposed in the cylinder shell 40, to operate the lock mechanism as the key turns.

The auxiliary locking mechanism 120 includes an auxiliary locking pin 122, a pin spring 134, a pin-actuating slider 136, and a slider spring 152. Further details of the auxiliary locking mechanism 120 are shown in FIGS. 2, 4, 6, 7, 9 and 11.

The auxiliary locking mechanism 120 is housed inside the plug 70. More specifically, the slider 136 and slider spring 152 are disposed within an axially arranged slider cavity 160, and the locking pin 122 and the pin spring 134 are disposed with a pin cavity 170 formed generally a right angle to the slider cavity 160 (See FIGS. 4 and 9). The slider 136 is biased by spring 152 disposed between a back end of the slider 136 and a back end of the cavity 160 opposite the forward end of the slider cavity 160 (i.e., toward the head 86 of the plug 70).

The auxiliary locking pin 122 includes an upper shaft 124, which is surrounded by the pin spring 134, and a lower point, or tip, 128 that is in contact with the slider 136. The auxiliary locking mechanism 120 effects auxiliary locking by the top 126 of the upper shaft 124 extending through auxiliary locking hole 78 and 32 (formed in the plug 70 and the control sleeve 20, respectively) into gap 48 defined within recess 46 adjacent the raised portion 22 (see FIGS. 4 and 6). The locking pin 122 then resists rotation of the plug 70 by contacting the sides of hole 32. The auxiliary locking pin 122 must provide enough strength to resist a rotational force upon the plug 70. In particular, if a lock 10 were compromised by aligning the tumblers with the shear line (e.g., by bumping the lock), the auxiliary locking pin 122 ought to be able to resist rotation of the plug 70. A preferred material for the auxiliary locking pin 122 is stainless steel.

The top 126 of the auxiliary locking pin 122 is sloped to conform with the peripheral curvature of cylindrical plug 70.

Figure 6:
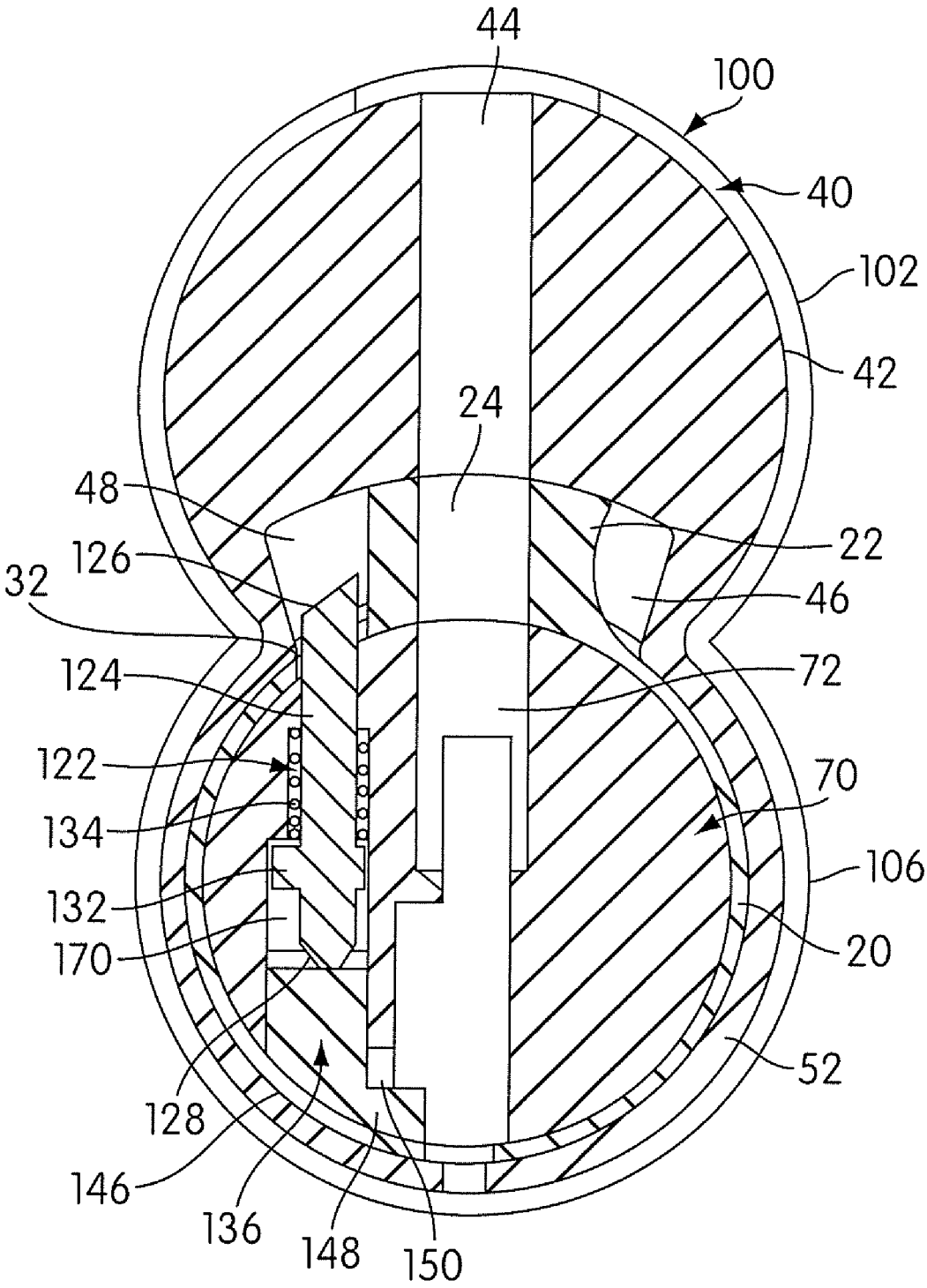
FIG. 6 is an end cross-sectional view of the cylinder lock along the line 6-6 in FIG. 5 with the slider and the auxiliary locking pin both in respective first positions.
Figure 11:
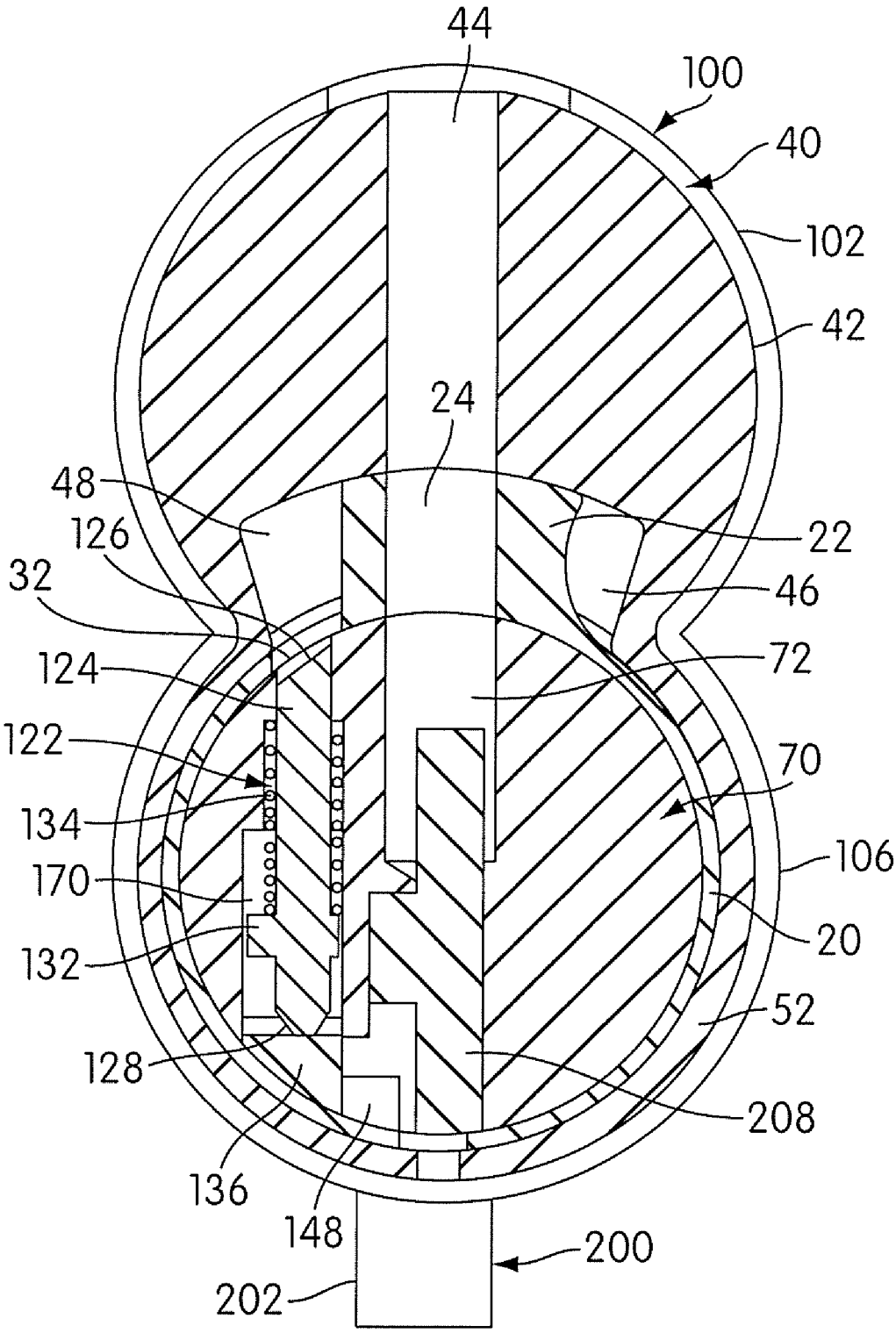
FIG. 11 is an end cross-sectional view of the cylinder lock along the line 11-11 in FIG. 10 with the slider and the auxiliary locking pin both in respective second positions.

The auxiliary locking pin 122 includes a radial shoulder 130 to provide a stop for the pin spring 134. A shoulder projection 132 protrudes from the shoulder 130 toward the face of the locking cylinder 10. The auxiliary locking pin spring 134 is disposed around the upper shaft 124 and extends from the shoulder 130 into a counterbore formed coaxially with pin hole 78 to provide a downward biasing force upon the auxiliary locking pin 122. The shoulder projection 132 is rectangular in cross-section and is sized to conform to the sides of the auxiliary pin cavity 170, as shown in FIGS. 6 and 11, to ensure that the auxiliary locking pin 122 does not rotate around its longitudinal axis. Because the tip 126 of the locking pin 122 is sloped to conform to the plug 70, it is important that the pin 122 maintain a consistent orientation and not rotate about its longitudinal axis. If the auxiliary locking pin 122 were to rotate about its longitudinal axis, the top 126 of the auxiliary locking pin 122 would slope in a direction not conforming with the curvature of the plug 70.

The bottom tip 128 of the auxiliary locking pin 122 sits atop the slider 136.

Figure 13:
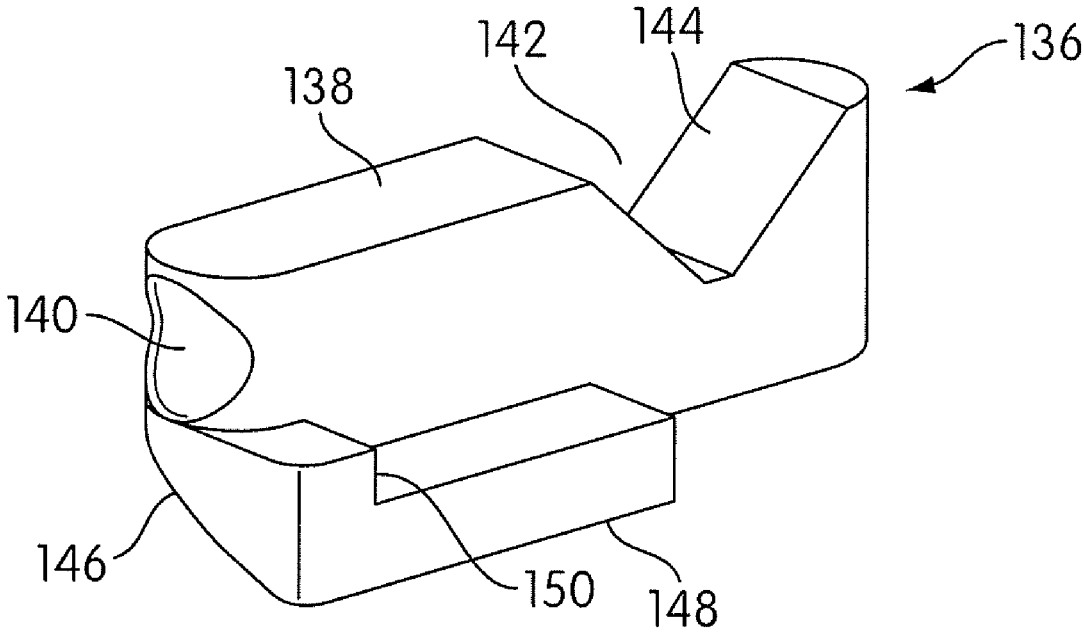
FIG. 13 is a rear perspective view of a slider for use in an auxiliary locking mechanism according to the present invention.
Figure 14:
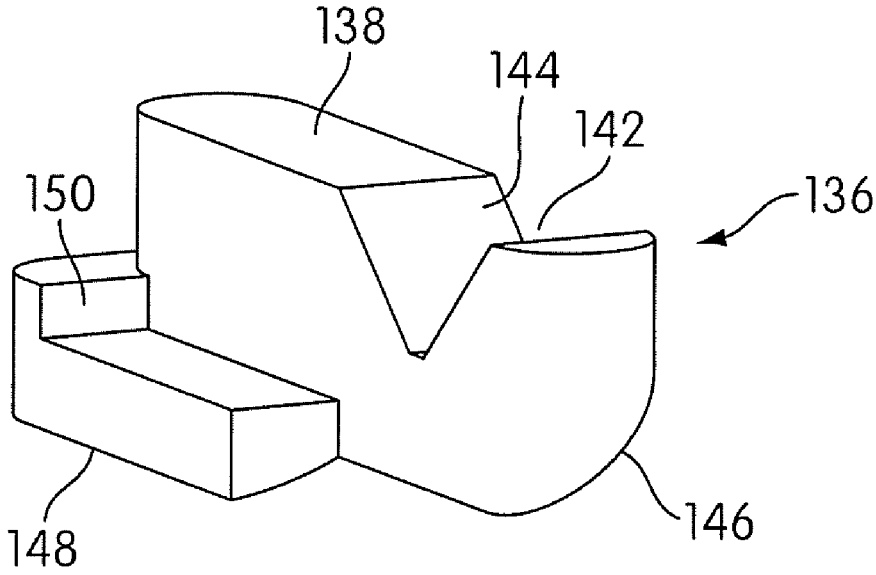
FIG. 14 is a front perspective view of the slider.
Figure 15:
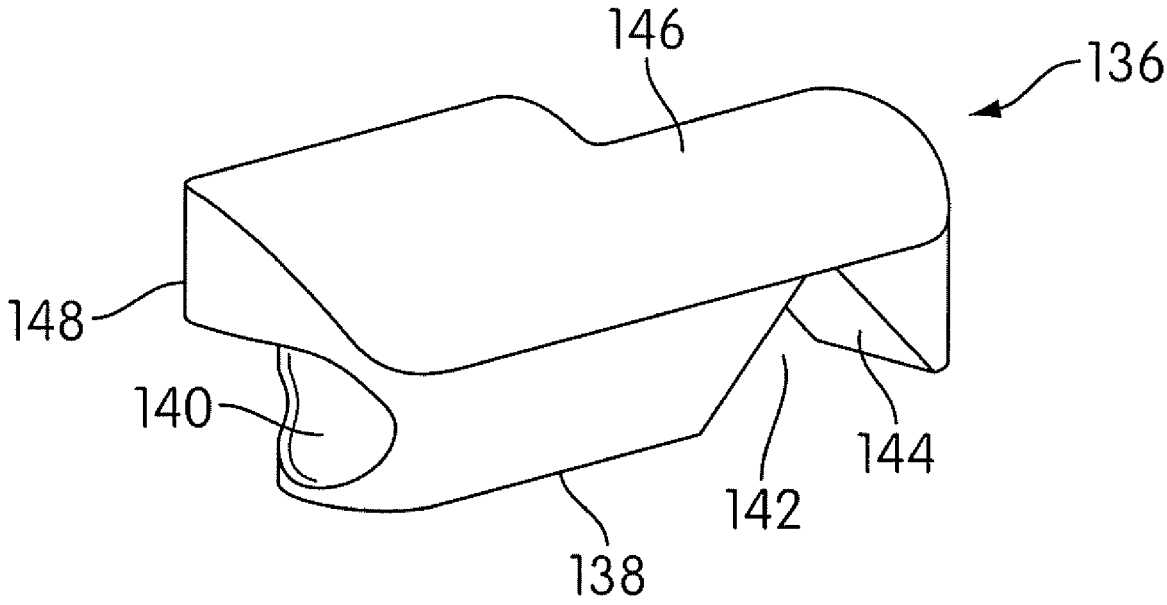
FIG. 15 is a bottom rear perspective view of the slider.

As shown in FIGS. 13-15, slider 136 includes an angled notch 142 which defines angled side walls 144, a rear body portion 138, a spring hole 140 formed in the rear body portion 138 in an axial orientation with respect to the plug 70, and a curved bottom portion 146 having a curvature generally conforming to the peripheral curvature of the plug 70. Slider 136 further includes a side projection 148 defining a contact surface 150. When the slider 136 is installed in the slider cavity 160, the side projection 148 and the contact surface 150 extend into the keyway 80, and the bottom portion 146 conforms to the curvature of the plug 70, so the slider 136 is retained within the slider cavity 160 by the control sleeve 120.

Figure 2:
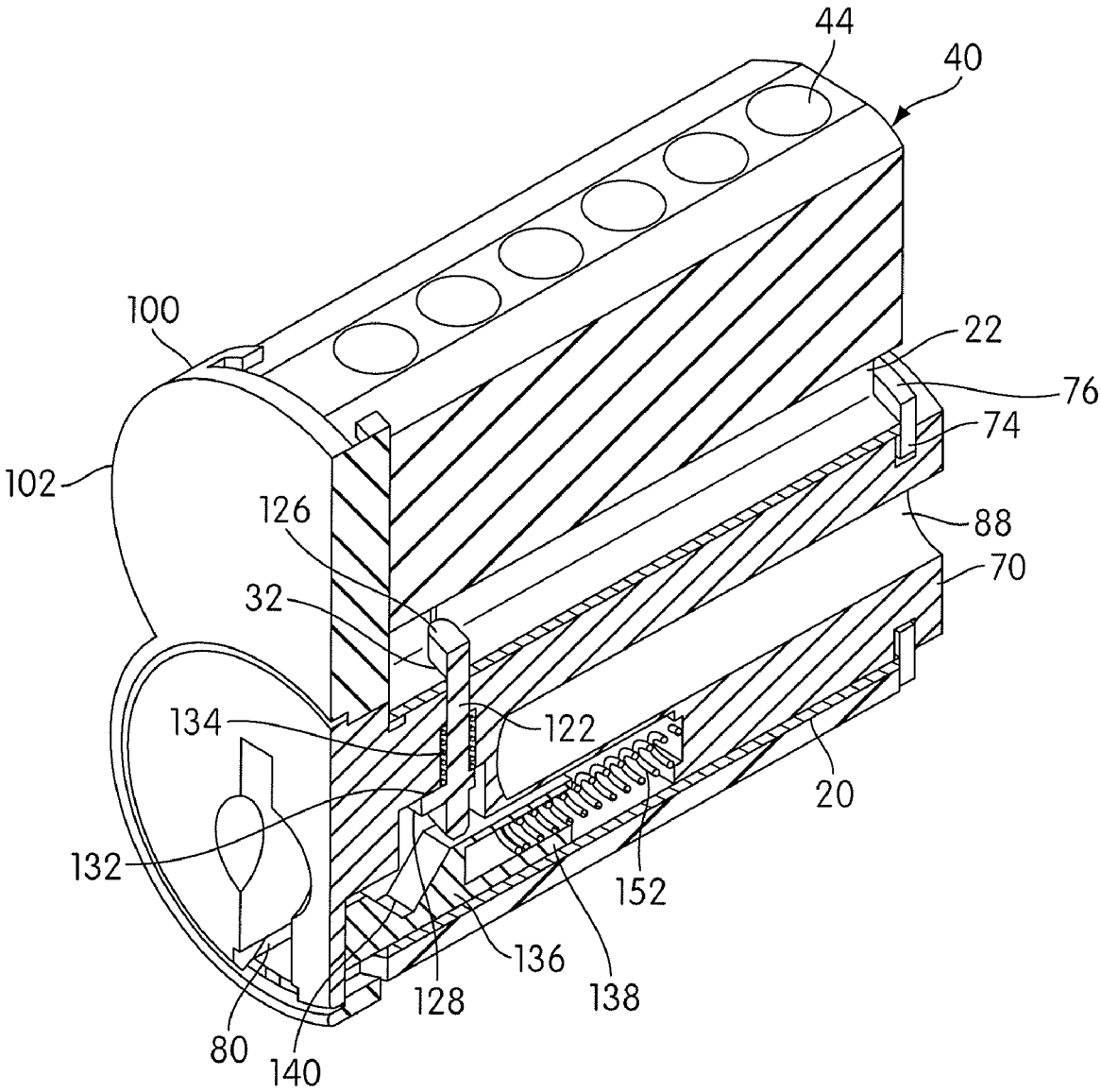
FIG. 2 is a cross-sectional perspective view of the cylinder lock without a key inserted and with a slider and an auxiliary locking pin both in respective first positions.
Figure 3:
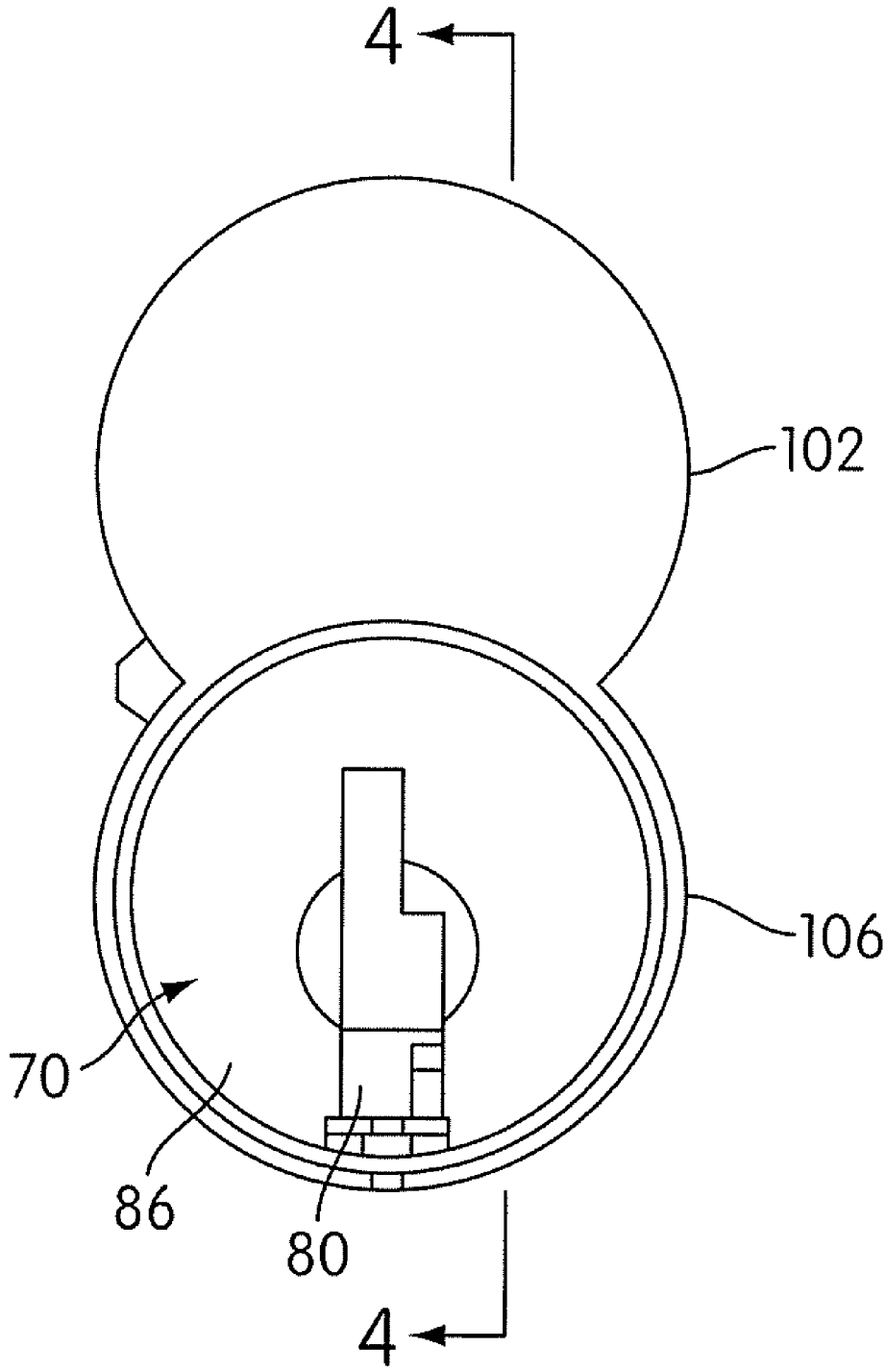
FIG. 3 is an end view of the cylinder lock without a key inserted.
Figure 4:
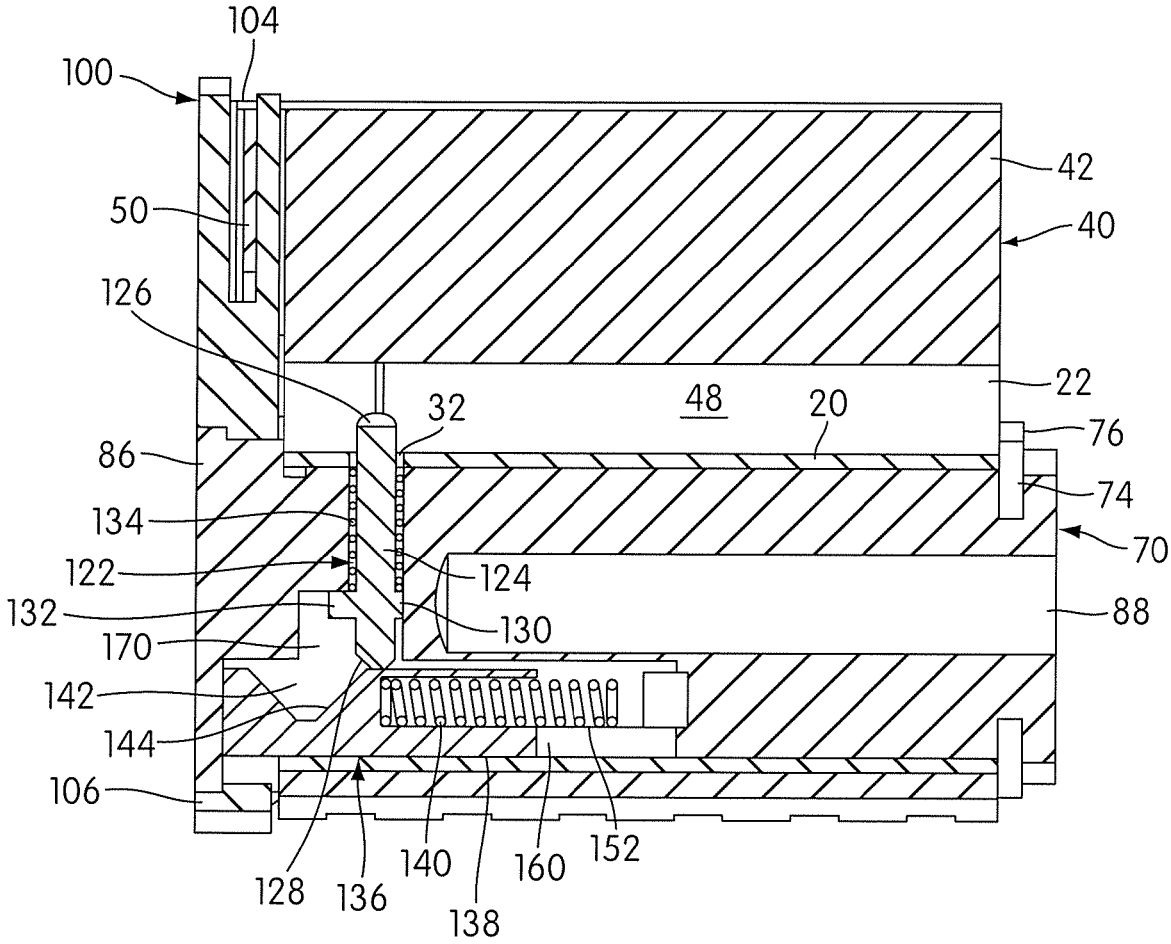
FIG. 4 is a side cross-sectional view of the cylinder lock along the line 4-4 in FIG. 3 with the slider and the auxiliary locking pin both in respective first positions.
Figure 5:
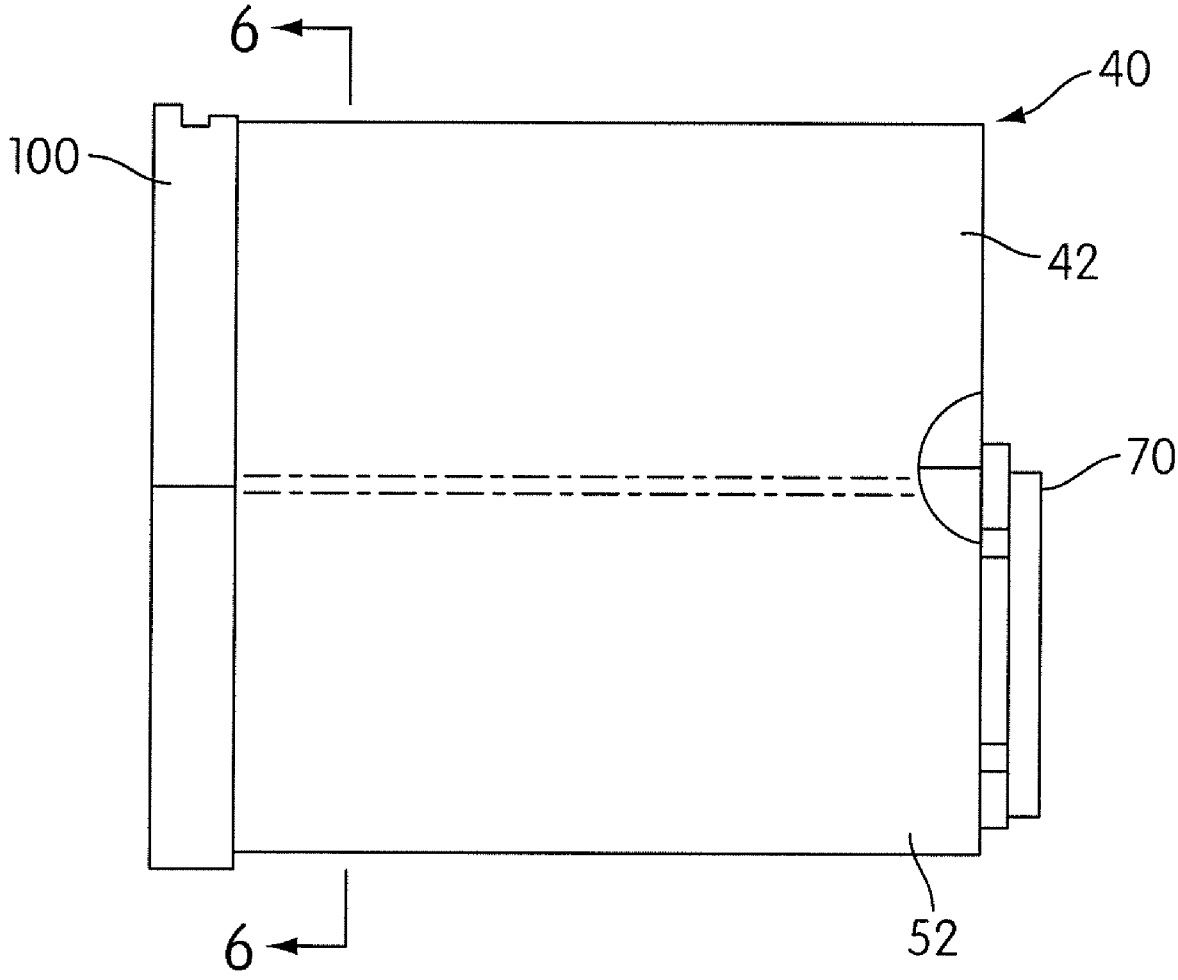
FIG. 5 is a side view of the cylinder lock without a key inserted.
Figure 7:
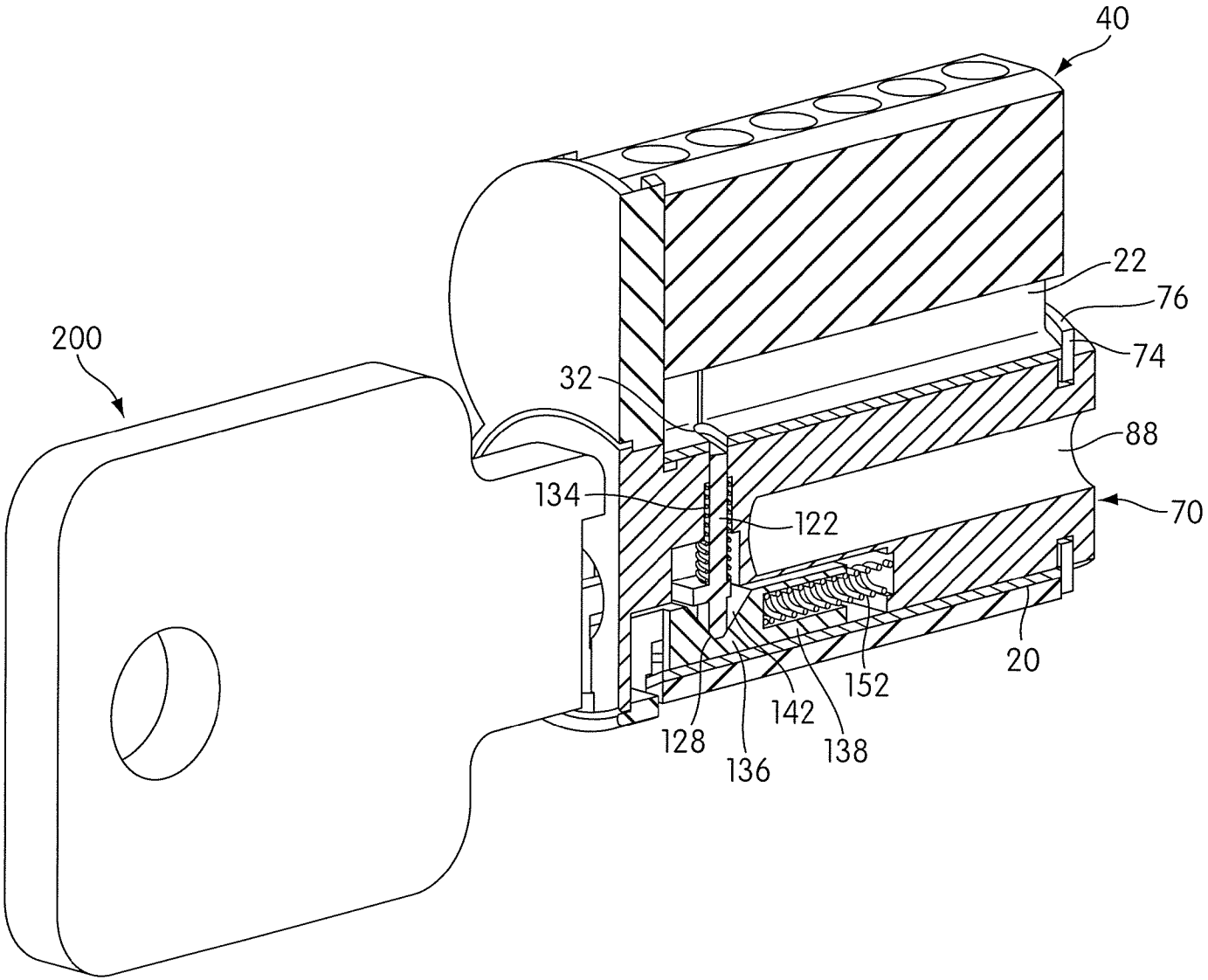
FIG. 7 is a cross-sectional perspective view of the cylinder lock with a key inserted into the lock and with the slider and the auxiliary locking pin both in respective second positions.
Figure 8:
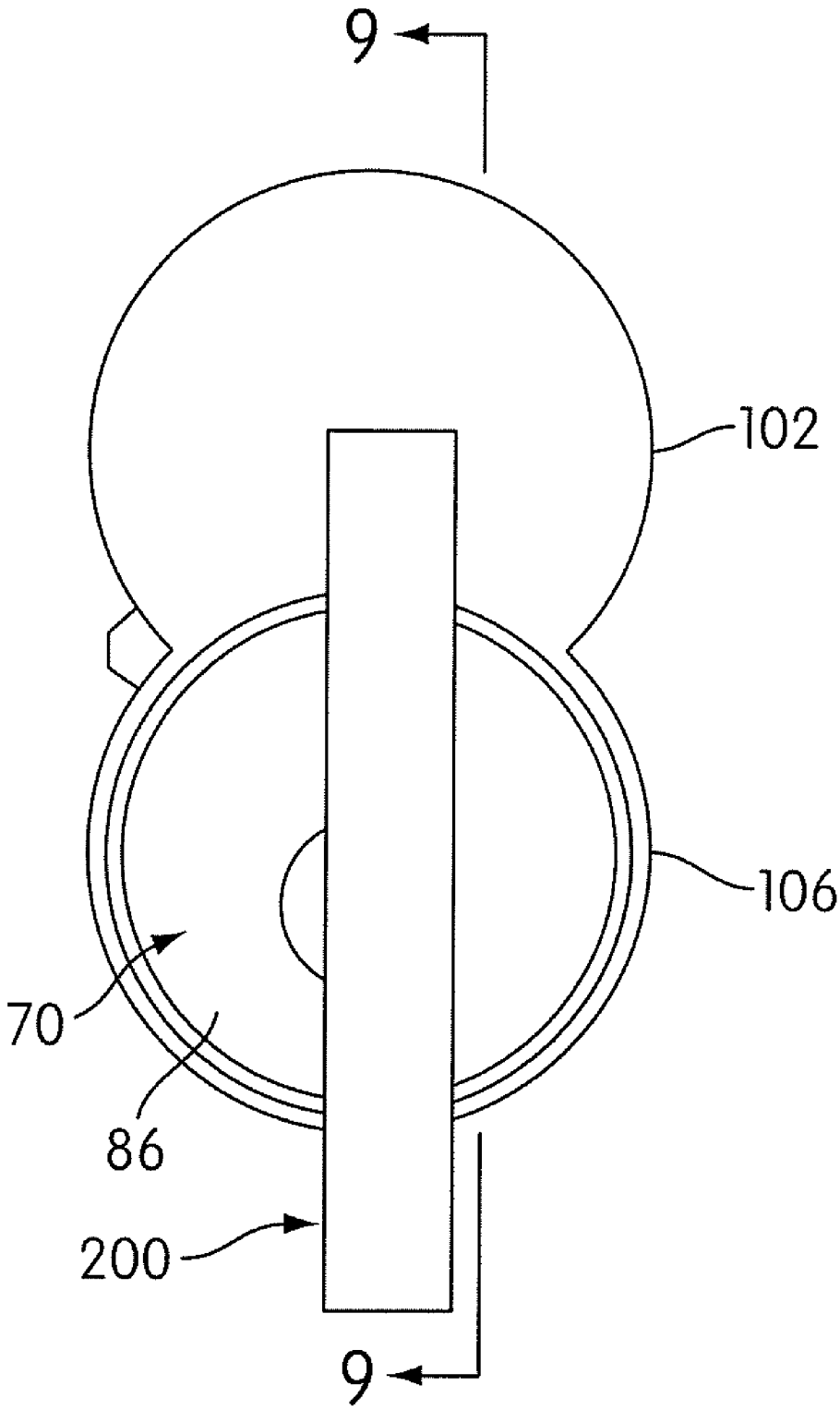
FIG. 8 is an end view of the cylinder lock with a key inserted into the lock with the slider and the auxiliary locking pin both in respective second positions.
Figure 9:
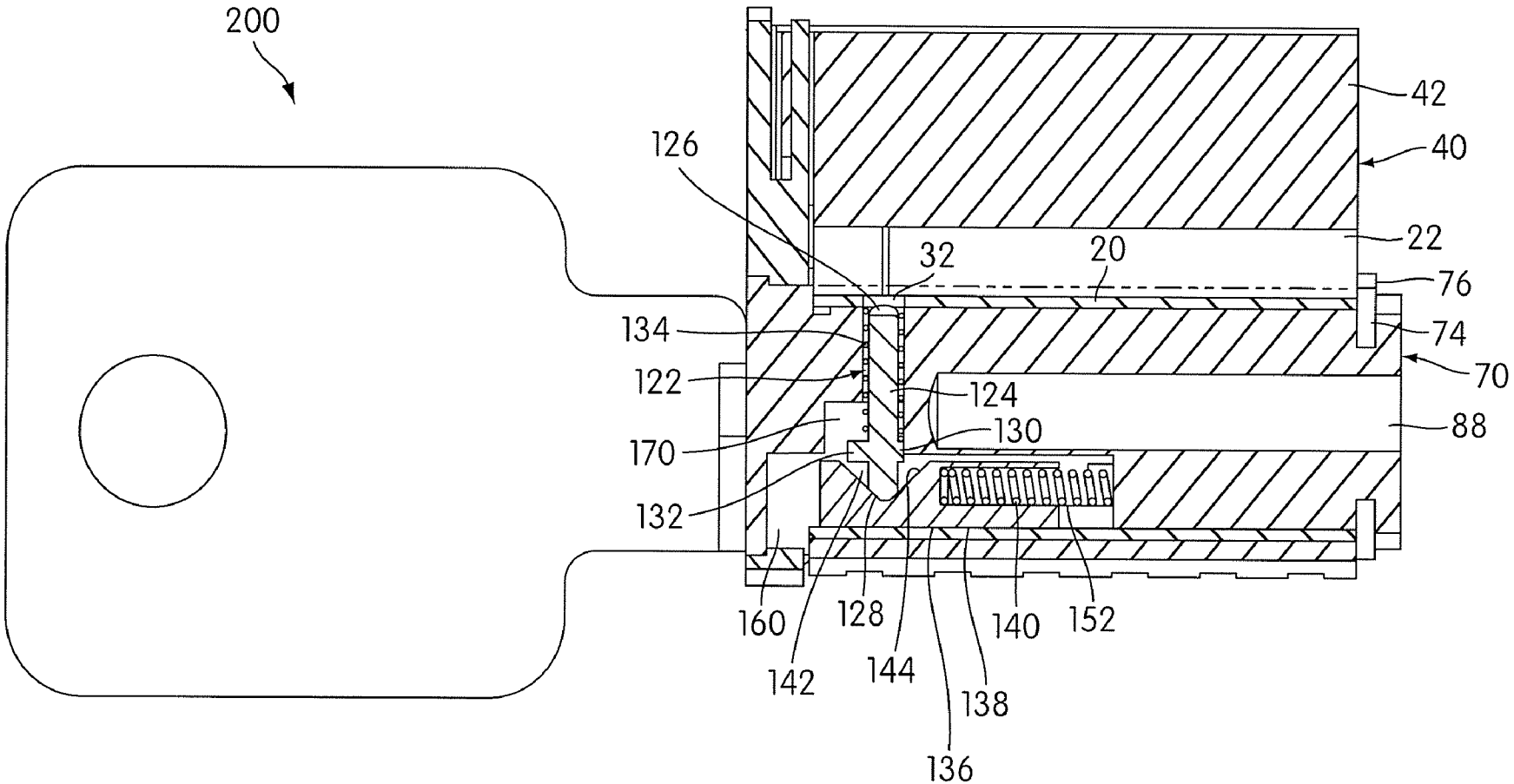
FIG. 9 is a side cross-sectional view of the cylinder lock along the line 9-9 in FIG. 8 with the slider and the auxiliary locking pin both in respective second positions.
Figure 10:
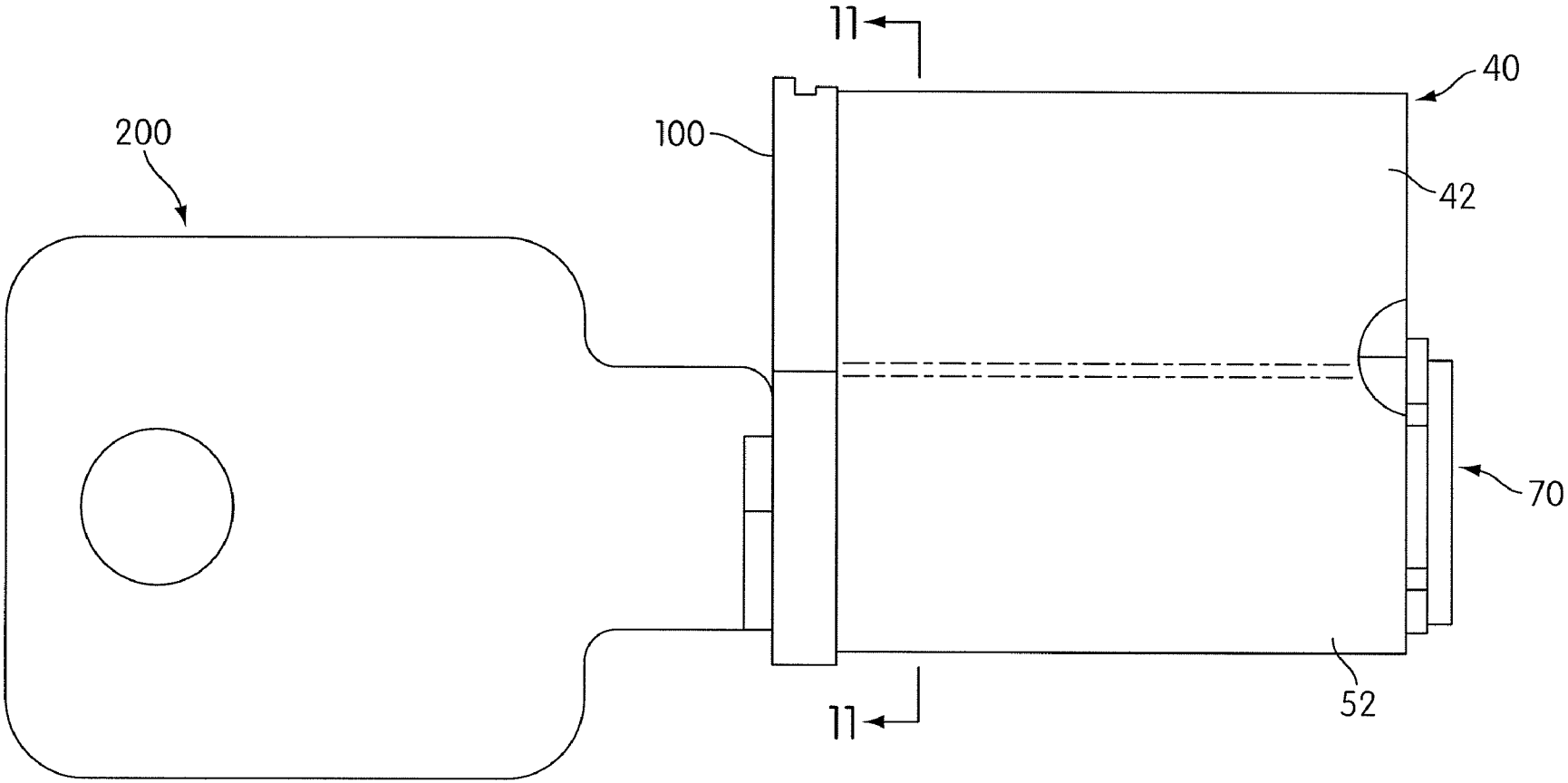
FIG. 10 is a side view of the cylinder lock with a key inserted.

As shown in FIGS. 2 and 4, the slider spring 152, having one end inserted into spring hole 140, urges the slider 136 toward a first position at the forward end of the slider cavity 160. As shown in FIGS. 2, 4, and 6, with the slider 136 in this forward position, the pin 122 contacts the top of the rear main body 138 of the slider, thereby holding the pin in a first position with the upper shaft 124 extending through the auxiliary pin locking hole 122 into the gap 48 to prevent rotation of the plug 70 and preventing the pin 122, which is biased downwardly by the pin spring 134, from moving from this first position. When engaged by a key (as described in more detail below), the slider 136 is moved, against the bias of the slider spring 152, to a second position toward the back of the slider cavity 160. Meanwhile, the tip 128 of the auxiliary locking pin 122 slides along the top of the slider and into the notch 142, sliding along the angled wall 144 to the bottom of the notch 142, as shown in FIGS. 7, 9, and 11. With the pin 122 moved into this second position, the upper shaft 124 withdraws from the gap 48, through the auxiliary pin hole 32 formed in the control sleeve 20, so that the plug 70 may rotate within the control sleeve 20.

When a key is removed, the slider 136 is allowed to move under the force of spring 152 from the second position to the first position toward the front of the slider cavity 160. The tip 128 of the auxiliary locking pin 122 slides up along the angled wall 144 to the top of the rear main body 138 of the slider 136. The upper shaft 124 again protrudes through auxiliary locking pin hole 32 into gap 48, and the plug 70 is again locked against rotation.

Preferably, the angled side walls 144 of the notch 142 form an angle of about 90°. If the angles of the side walls 144 are too steep, then it will be difficult for the tip 128 of the auxiliary locking pin 122 to slide up the side wall 144 and out of the angled groove 142 as the slider 136 moves from the back, second position to the forward, first position. On the other hand, if the angles of the side walls 144 are too shallow, the linear distance required for the angled notch 142 to reach the necessary depth to permit the upper shaft 124 of the locking pin 122 to fully withdraw from the gap 48 will be too great, which will require an unnecessarily long slider.

Figure 12:
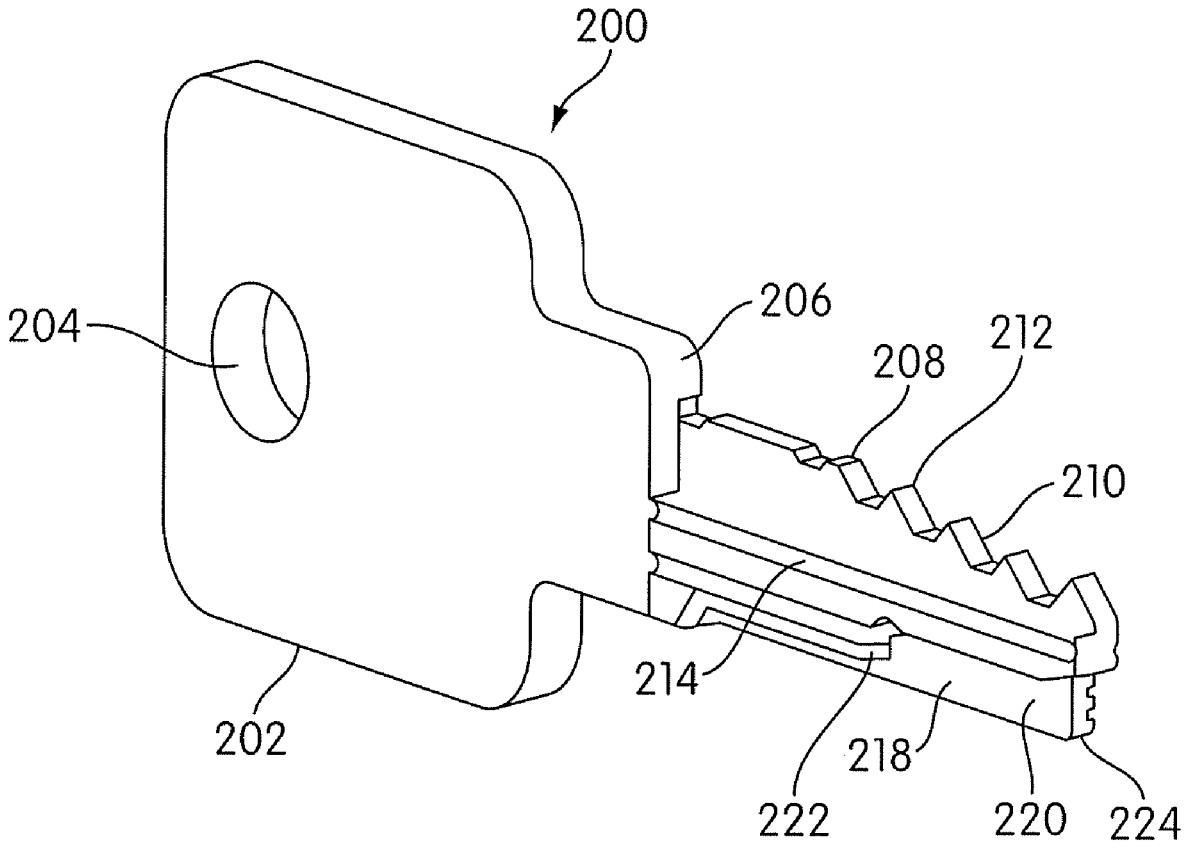
FIG. 12 is a perspective view of a key for use in the cylinder lock of the present invention.

A key 200 configured for use in the cylinder lock 10 is shown in FIG. 12. Key 200 includes a bow 202, which may include a key ring hole 204, a shoulder, or key stop, 206, and a key blade 208. Key blade 208 includes a biting edge 210 having teeth 212. A slider catch 218 is formed in a lower, forward edge of the key blade 208. The slider catch 218 comprises a slider cut 220, which is intended to move past the slider (not shown), and a slider contact surface 222, which is intended to engage the slider contact surface 150. The distal end of the key blade has a tip stop 224. Blade profile features, such as longitudinal shelf 214, may be provided to control access to the keyway by forming a keyblade and keyway to have conforming profiles permit the only the correctly-profiled key to be inserted into a keyway.

When key 200 is inserted into the keyway 80, the teeth 214 of the biting 210 engage pin stacks 90 to elevate the tumblers to correct positions to unlock the plug 70. The depth to which the key 200 can be inserted into the keyway 80 will be determined by the shoulder 206 or the tip stop 224. Also, the slider contact surface 222 will engage the contact surface 150 of the slider 136 to move the slider from the first, locking position shown in FIGS. 2, 4, and 6 to the second, unlocked position shown in FIGS. 7, 9 and 11.

Figure 16:
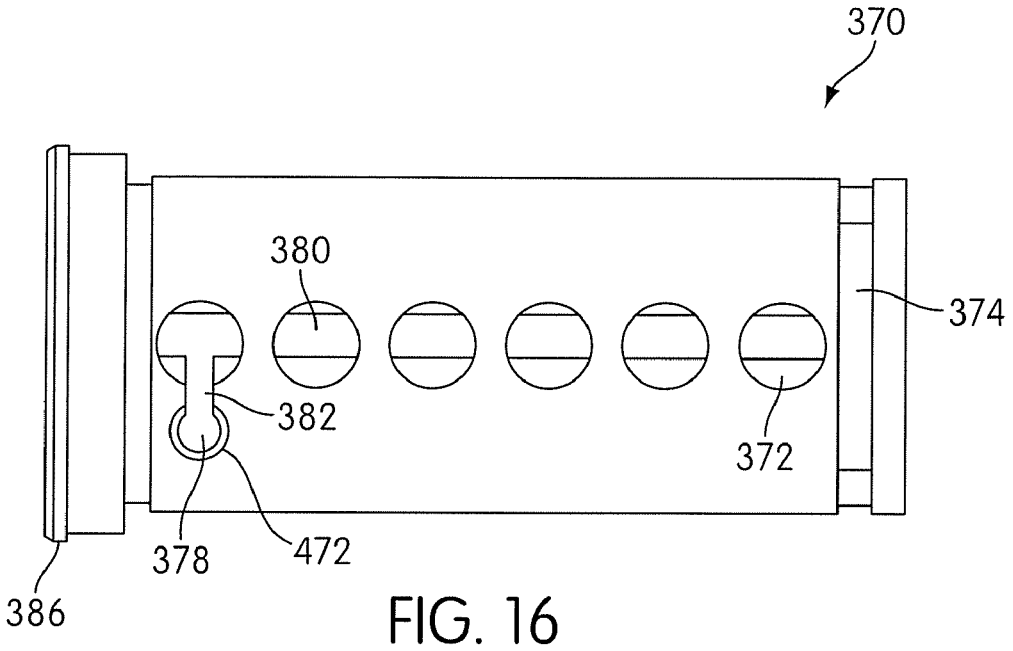
FIG. 16 is a top plan view of a cylinder plug of an alternative embodiment cylinder lock.
Figure 17:
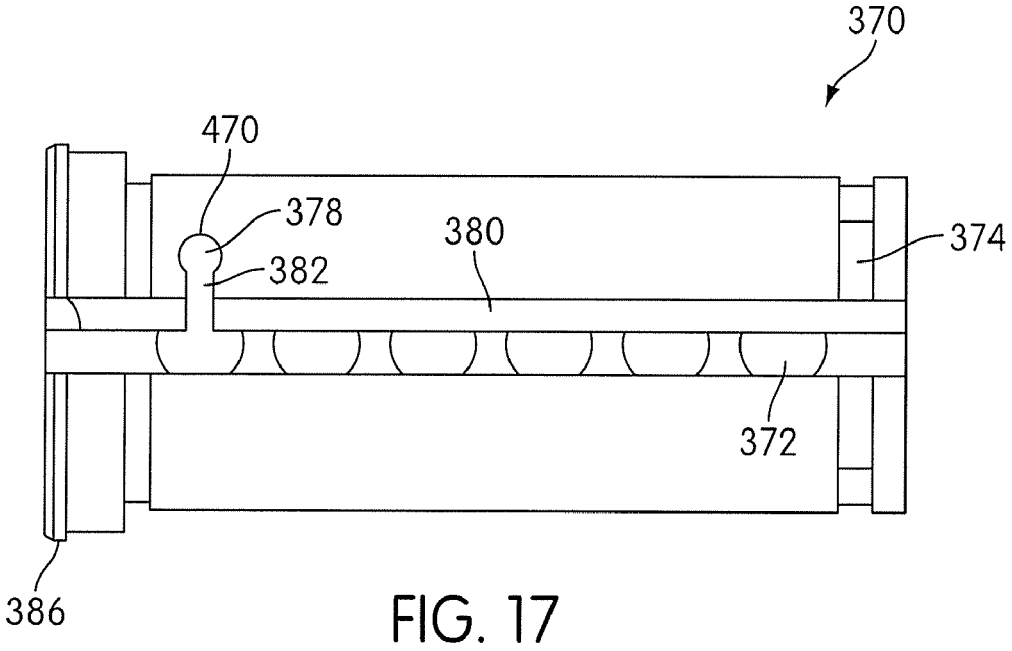
FIG. 17 is a bottom plan view of the cylinder plug shown in FIG. 16.
Figure 18:
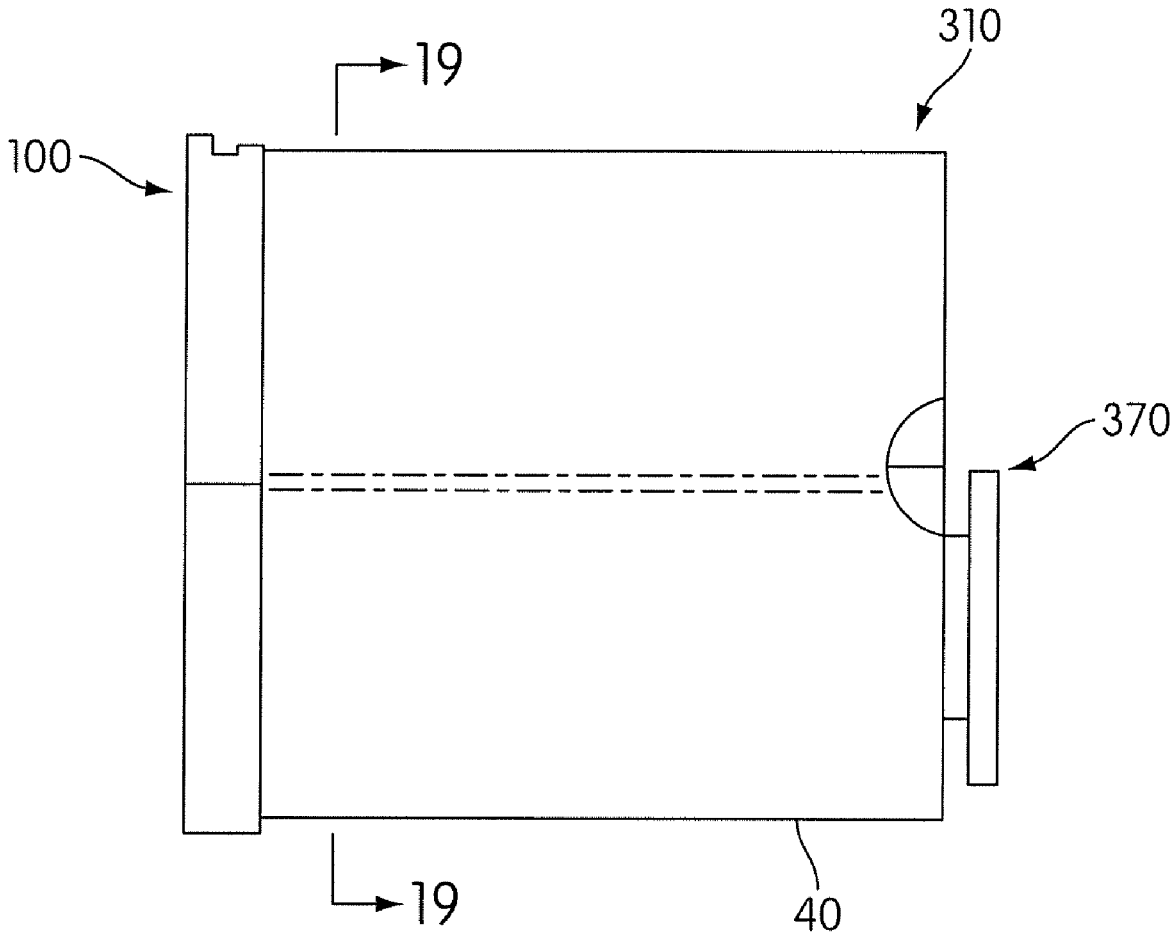
FIG. 18 is a side view of a cylinder lock.
Figure 19:
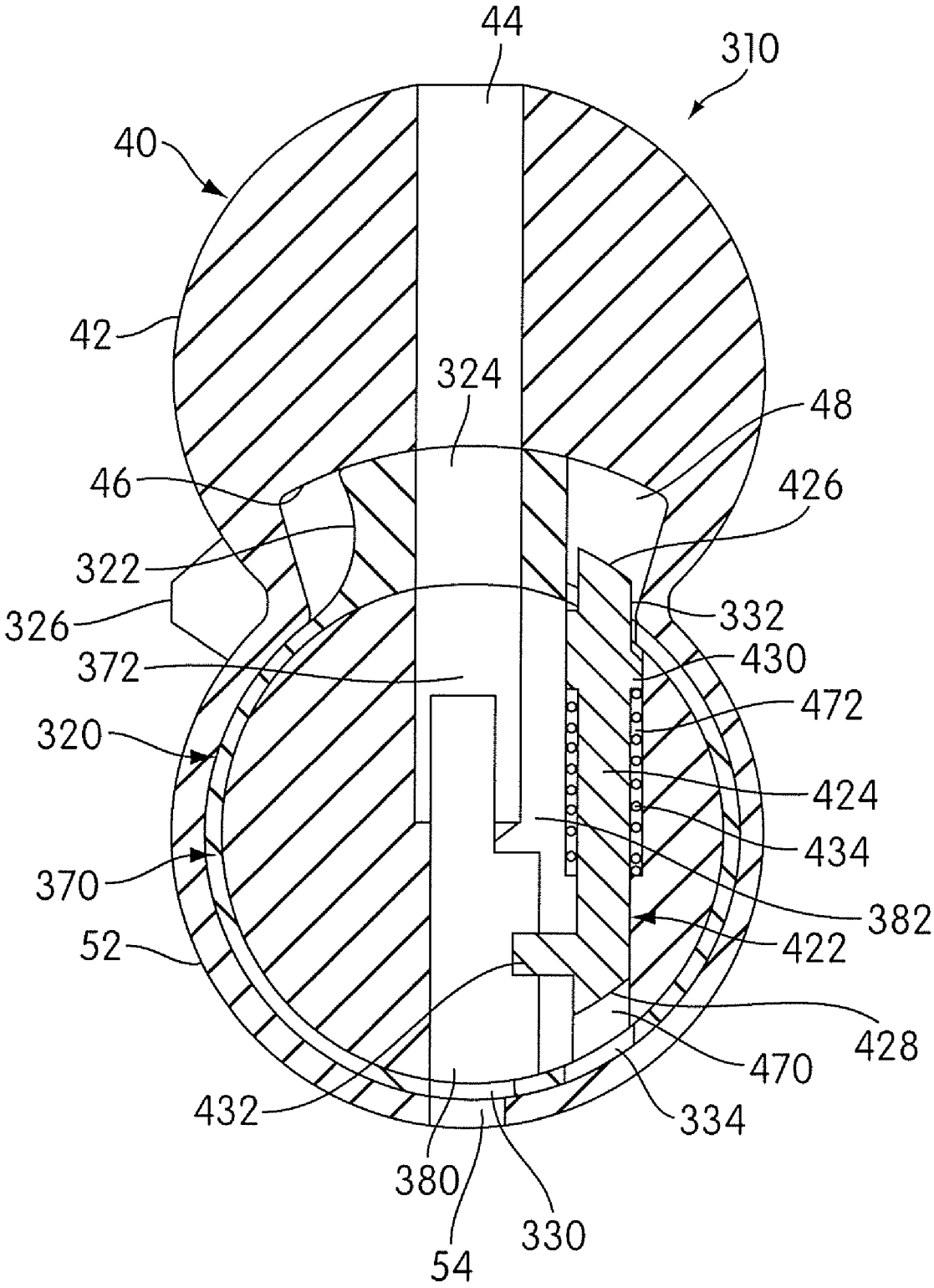
FIG. 19 is an end cross-sectional view of the cylinder lock along the line 19-19 in FIG. 18 showing an alternative embodiment without a key inserted and with an auxiliary locking pin in a first position.

FIGS. 16-23 illustrate components of a cylinder lock according to an alternative embodiment of the invention. The cylinder lock according to this alternative embodiment, like cylinder lock 10 described above, includes an auxiliary locking mechanism which includes an auxiliary locking pin, but does not include a slider which actuates the pin. FIG. 18 shows a side view of a cylinder lock 310, and FIG. 19 shows a cross-section of the cylinder lock 310 of FIG. 18. Cylinder lock 310 includes a cylindrical plug 370, a control sleeve 320, a shell 40, a faceplate 100, and an auxiliary locking pin 422 As with cylinder lock 10 described above, cylinder lock 310 shown in FIGS. 18-22 is of the type known as a small format interchangeable core cylinder. This is merely for the purpose of illustrating this alternative embodiment of the inventive lock incorporating an auxiliary locking mechanism and is not intended to be limiting, as the auxiliary locking mechanism could be incorporated into other locks as well.

The shell 40 of the alternative embodiment shown in the figures is identical to shell 40 described above, and thus the description will not be repeated.

The control sleeve 320 is housed inside the shell 40. Control sleeve 320 has a hollow, cylindrical configuration with a raised portion 322. Tumbler holes 324 formed in the raised portion 322 of the control sleeve 320 align with tumbler holes 44 formed in the shell 40 when the control sleeve 320 is inserted into the shell 40, such that tumblers (described above) inside may move up and down to control rotation of the plug 370 in a conventional manner. Service holes 330 formed in the bottom of the control sleeve 320 align with service holes 54 formed in the shell 40. The control sleeve 320 includes a control lug 326 along part of one side of the raised portion 322. Raised portion 322 of the control sleeve 320 is received within the recess 46 formed in the upper section 42 of the shell 40, and control lug 326 interlocks with the bottom of the upper section 42 of the shell 40 to lock the control sleeve 320 within the shell 40. The control sleeve 320 further includes an upper auxiliary locking pin hole 332 and a lower auxiliary locking pin hole 334.

The faceplate 100 of the alternative embodiment and its engagement with shell 40 is identical to faceplate 100 described above, and thus the description will not be repeated.

The plug 370 is mounted for axial rotation within the control sleeve 320, which is disposed within the lower section 52 of the shell 40. Tumbler holes 372 are formed in the plug 370 and communicate with a keyway 380 formed axially into the plug 370. Tumblers (described above) disposed within the tumbler holes 372 operate along with a key in a conventional manner to control rotation of the plug 370.

Plug 370 further includes an auxiliary locking pin hole 378, which includes an upper pin cavity 472 and a lower pin cavity 470 having a smaller diameter than the upper spring cavity 472. As shown in FIGS. 16 and 17—which show top and bottom plan views, respectively, of the cylinder 370—an area, designated by reference number 382, between the hole 378 and keyway 380 and one of the tumbler holes 372 is broached. The purpose of this broached area will be described below.

The auxiliary locking pin 422 is disposed within auxiliary pin locking hole 378. The auxiliary locking pin 422 includes a shaft 424, an upper tip 426, a spring shoulder 430, a key contact projection 432, and a lower point, or tip, 428. A pin spring 434 surrounds the upper shaft 424. The auxiliary locking pin 422 effects auxiliary locking by the upper tip 426 of the auxiliary locking pin 422 extending from the auxiliary locking pin hole 378 through auxiliary pin hole 332 formed in the control sleeve 320 and into gap 48 defined within recess 46 adjacent the raised portion 322 (see FIG. 19). The locking pin 422 resists rotation of the plug 370 by contacting the sides of hole 332. A preferred material for the auxiliary locking pin 422 is stainless steel.

The tip 426 of the auxiliary locking pin 422 may be sloped to conform with the peripheral curvature of cylindrical plug 370.

Figure 21:
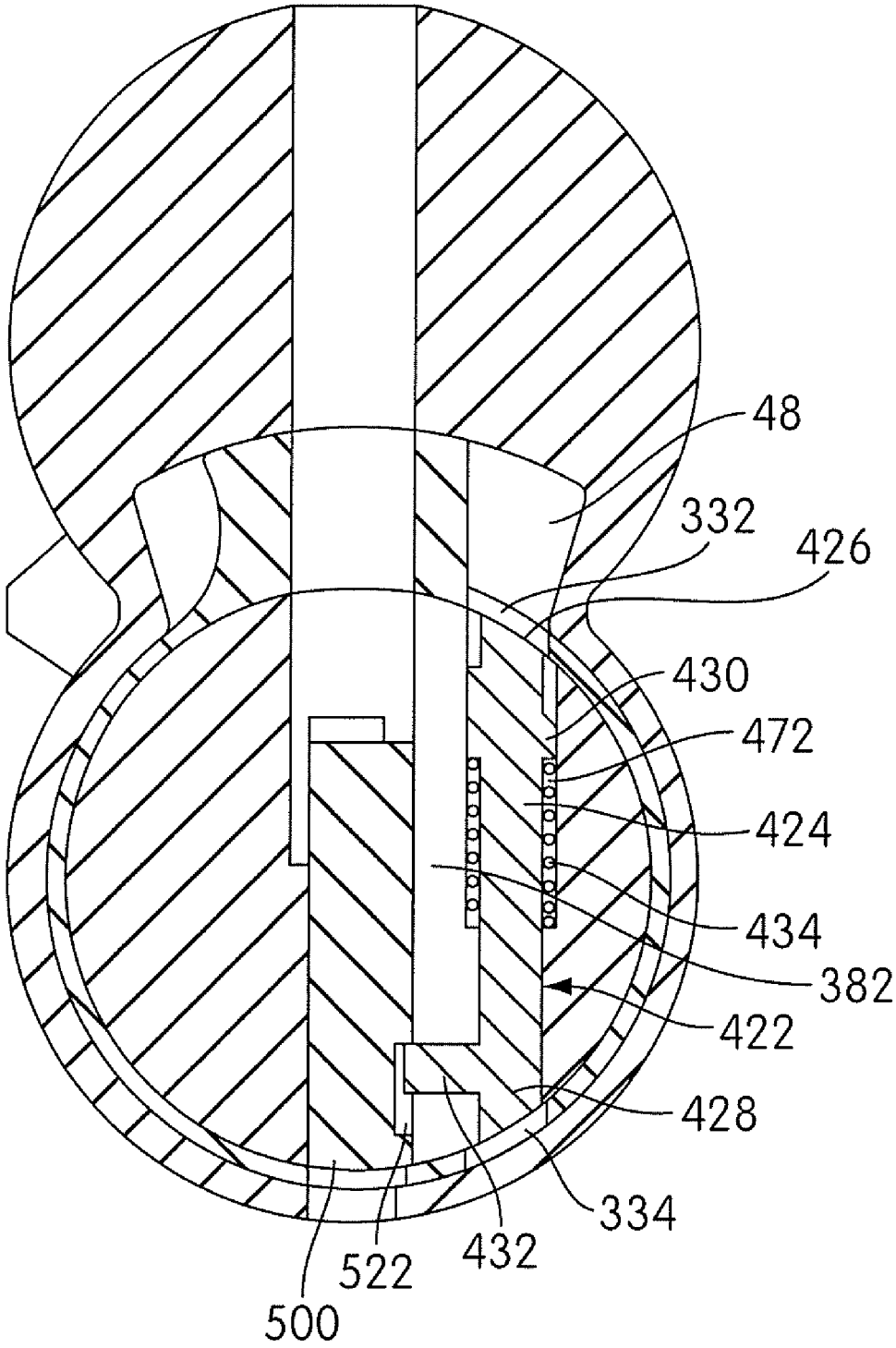
FIG. 21 is an end cross-sectional view of the cylinder lock along the line 21-21 in FIG. 20 showing the alternative embodiment with the auxiliary locking pin in a second position.
Figure 22:
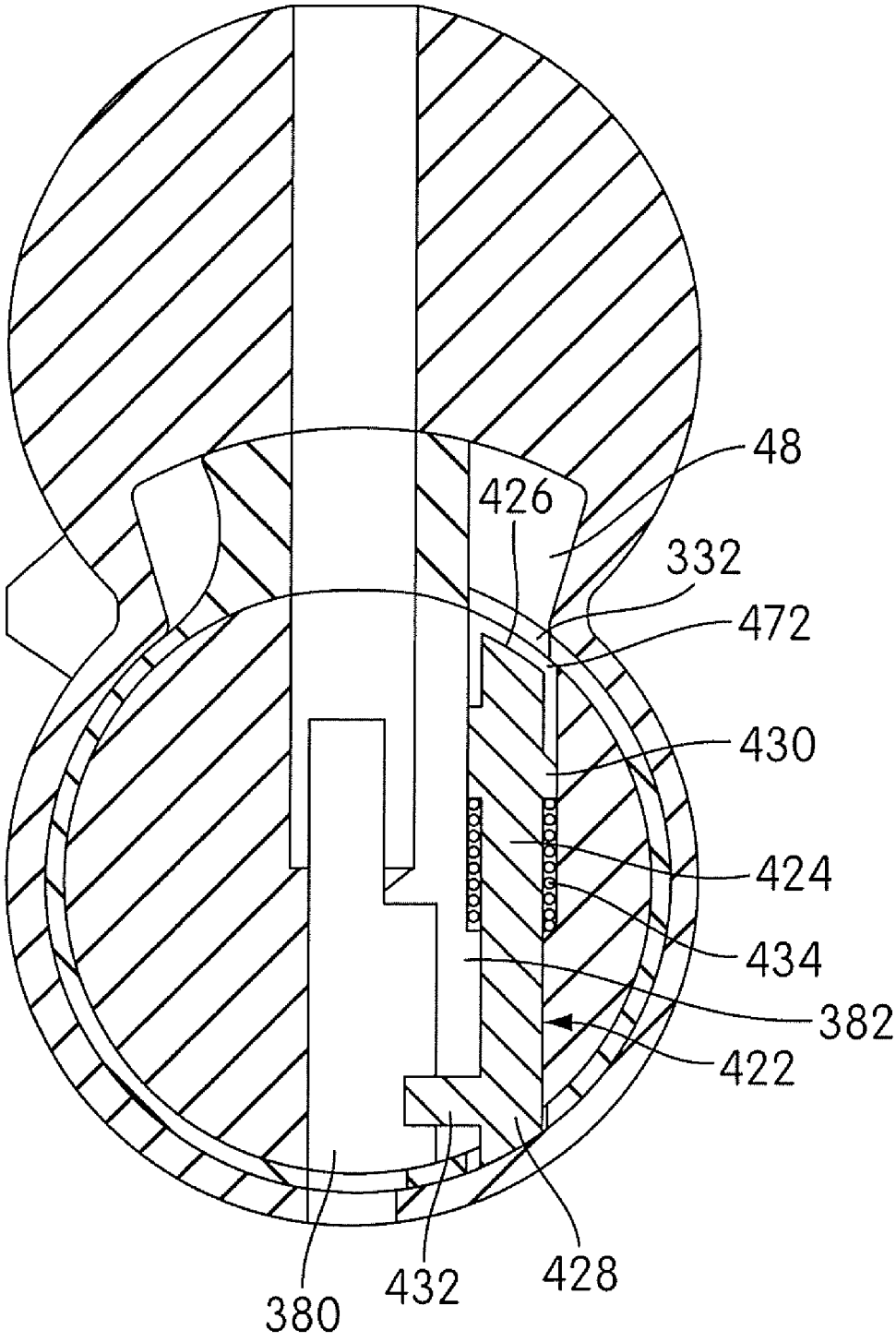
FIG. 22 is an end cross-sectional view of the cylinder lock along the line 19-19 in FIG. 18 showing the alternative embodiment with the auxiliary locking pin in a third position.

The spring shoulder 430 of the auxiliary locking pin 422 provides a stop for the pin spring 434. More specifically, spring shoulder 430 has a transverse dimension (e.g., diameter) that is greater than that of the upper shaft 424 and the upper tip 426. The bottom of the spring shoulder 430 forms a radial flange that is substantially perpendicular to the longitudinal axis of the auxiliary locking pin 422. In the illustrated embodiment, the top 426 has a smaller transverse dimension (e.g., diameter) than the spring shoulder 430 so as to fit within the gap 48. Also, as seen in FIGS. 19, 21, and 22, the lower pin cavity 470 has a smaller transverse dimension (e.g., diameter) than the upper pin cavity 472. The change in dimension between the lower pin cavity 470 and the upper pin cavity 472 defines a radial ledge.

Pin spring 434 surrounds a portion of the upper shaft 424 and resides within the upper pin cavity 472 where it is retained between the radial flange defined at the bottom of the spring shoulder 430 and the radial ledge defined at the transition of the lower pin cavity 470 and the upper pin cavity 472.

Pin spring 434 biases the auxiliary locking pin 422 upwardly. Thus, when the locking pin 422 is unengaged by a key, as shown in FIG. 19, it is in a first position, extending, under the bias force provided by the pin spring 434, through the upper auxiliary locking pin hole 332 of the control sleeve 320 to prevent the cylindrical plug 370 from rotating.

Figure 20:
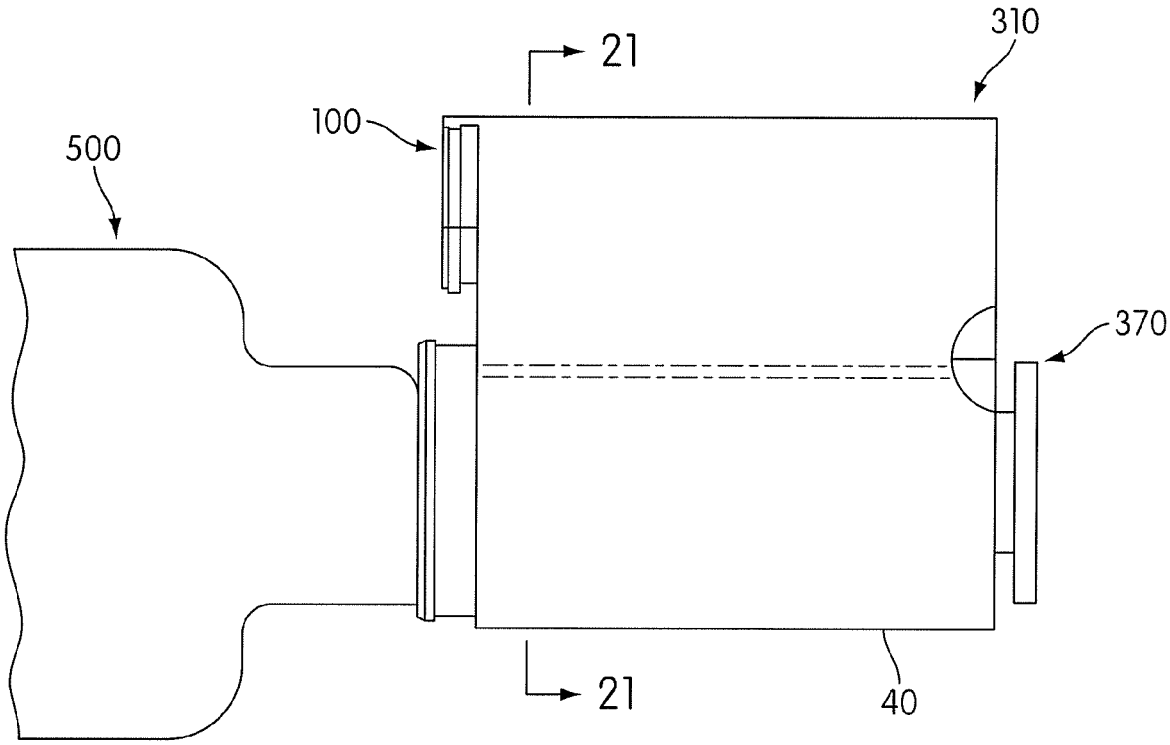
FIG. 20 is a side view of a cylinder lock with a key inserted

The auxiliary locking pin 422 also includes a key contact extension 432, which extends laterally through the broached area 382 adjacent the lower pin cavity 470 into the keyway 380. FIG. 20 shows a side view of the cylinder lock 310 with a key 500 inserted into the keyhole thereof. FIG. 21 is a transverse cross section of the cylinder lock 310 and key 500 taken through the auxiliary locking pin 422. As shown in FIGS. 20 and 21, when a properly configured key 500 (described in more detail below) is inserted into the keyway 380, it engages the extension 432 and pulls the auxiliary locking pin 422 down into a second position in which the upper tip 426 of the pin 422 is retracted into the plug 370 to thereby permit the plug 370 to rotate with respect to the control sleeve 320.

As shown in FIG. 22, if the auxiliary locking pin 422 is moved down too far within the auxiliary locking pin hole 378 into a third position (for example, if engaged by the wrong key or if the pin is moved down too far in an attempt to pick the lock), the lower tip 428 of the pin 422 will extend through the lower auxiliary locking pin hole 334 of the control sleeve 320 to again prevent rotation of the plug 370.

When the key is removed, the auxiliary locking pin 422 is allowed to move under the force of pin spring 434 from the second position shown in FIG. 21 back to the first position shown in FIG. 19 so that the upper tip 426 again protrudes through upper auxiliary locking pin hole 332 into gap 48, and the plug 370 is again locked against rotation.

Figure 23:
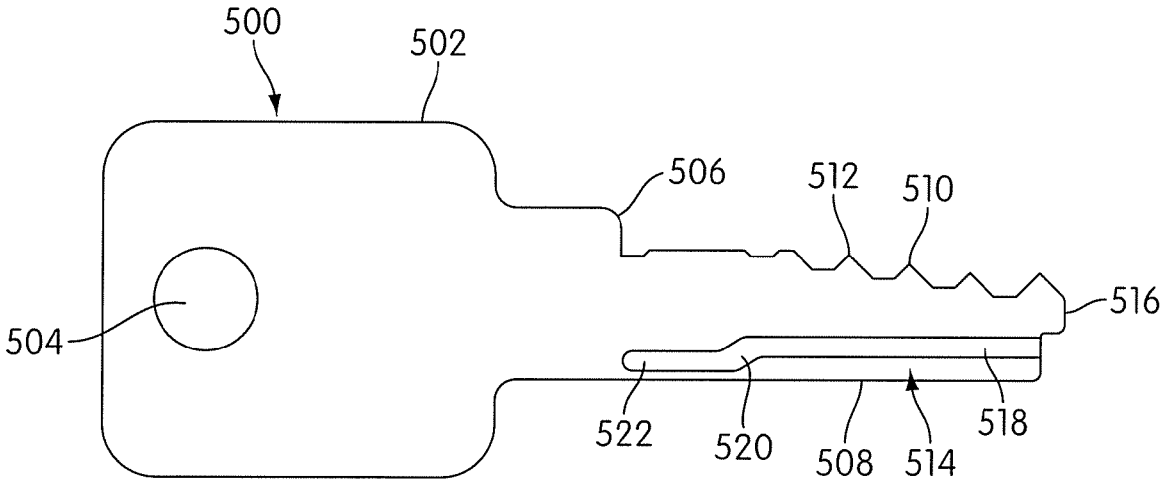
FIG. 23 is a side view of a key for use in the alternative embodiment.

A key 500 configured for use in the cylinder lock 310 is shown in FIG. 23. Key 500 includes a bow 502, which may include a key ring hole 504, a shoulder 506, and a key blade 508. Key blade 508 includes a biting edge 510 having teeth 512. The key 500 also includes a key stop 516.

A pin groove 514 is formed along the key blade 508. The pin groove 514 comprises a groove, or channel, having a first portion 518 which receives the key contact projection 432 when the key 500 is first inserted into the keyway 380 and the auxiliary locking pin 422 is in its first position. Progressing along the key blade 508, the pin groove 514 includes a transition 520, which, in the illustrated embodiment, moves closer to the bottom edge of the blade 508, to a terminal portion 522 of the groove 514. As the projection 432 moves along the groove 514, while the key 500 is inserted into the keyway 480, it moves from the initial portion 518, through the transition 520, and down to the terminal portion 522. The pin 422 is thus pulled down into the second position, retracted into the plug 370, thereby allowing the cylinder to rotate, assuming the tumblers are also properly aligned.

The auxiliary locking pin 422 is installed into the plug 370 by dropping it down into the auxiliary pin locking hole 378. The broached area 382 allows the pin 422, with the extending projection 432, to be inserted into the hole 378.

In a further embodiment, a cylinder lock may include an auxiliary locking mechanism comprising more than one auxiliary locking pin of the type shown in FIG. 19. That is, multiple auxiliary locking pins 422 can be provided along the length of the keyway 380, each locking pin having a key contact projection 432 at a different height, so that the pins are lowered by different amounts to permit rotation of the cylinder plug. The pin groove provided in a proper key would be shaped to accurately position each locking pin 422 into its respective second position. If the wrong key is used, and one or more pins is(are) moved too little or too much, the upper tip 426 or the lower tip 428 of the locking pin 422 will be engaged in the upper pin hole 332 or the lower pin hole 334 of the control sleeve 320 to prevent the cylinder plug from rotating. Such an arrangement may not, however, be possible if the cylinder includes longitudinal bores (such as longitudinal bores 88 shown in FIGS. 2 and 4).

Thus, a preferred embodiment has been fully described above with reference to the drawing figures. Although the invention has been described based upon this preferred embodiment, it would be apparent to those of skill in the art that certain modifications, variations, and alternative constructions could be made to the described embodiments within the spirit and scope of the invention.

The invention claimed is:

1. A lock comprising:

a cylindrical plug having an axially-extending keyway adapted to receive a conforming key;

a plurality of tumbler pins disposed within radially-oriented tumbler pin holes formed in said cylindrical plug and adapted to control rotation of said cylindrical plug, wherein said tumbler pins are constructed and arranged to be engaged by a properly configured key inserted into said keyway and to be positioned by the key within their respective tumbler pin holes so as to permit said cylindrical plug to rotate;

an auxiliary locking pin disposed within said cylindrical plug at a laterally-offset position with respect to said keyway and moveable between a first position in which a portion of said auxiliary locking pin extends out of a hole formed in an outer wall of said cylindrical plug and a second position in which said auxiliary locking pin is retracted into said hole; and a slider disposed within said cylindrical plug and moveable in an axial direction between a first position and a second position, said slider being constructed and arranged to be engaged by a cooperating key inserted into said keyway to move said slider from the first position to the second position, wherein said slider is operatively inter-engaged with said auxiliary locking pin such that said auxiliary locking pin is in its first position when said slider is in its first position and said auxiliary locking pin moves from its first position to its second position when said slider is moved from its first position to its second position.

2. The lock according to claim 1, wherein said slider is disposed within a recess formed in said cylindrical plug adjacent said keyway and includes a contact surface projecting into said keyway so as to be engageable by a key inserted into said keyway.

3. The lock according to claim 1, further comprising an auxiliary pin spring engaged with said auxiliary pin and constructed and arranged to urge said auxiliary pin toward its second position.

4. The lock according to claim 3, wherein said slider comprises:

a surface portion that, when said slider is in its first position, is engaged by a portion of said auxiliary locking pin to prevent said auxiliary pin spring from moving said auxiliary locking pin to its second position; and a notch configured to receive a portion of said auxiliary locking pin when said slider is in its second position so that when said slider is moved from its first position to its second position, the portion of said auxiliary locking pin engaged with said surface portion of said slider moves into said notch so as to permit said auxiliary pin spring to move said auxiliary locking pin to its second position.

5. The lock according to claim 1, further comprising a slider spring engaged with said slider and constructed and arranged to urge said slider toward its first position.

6. The lock according to claim 1, wherein said tumbler pin holes are parallel to each other and wherein said auxiliary locking pin includes a shaft that is oriented within said plug so as to be generally parallel to said tumbler pin holes.

7. The lock according to claim 1, further comprising a plug receiving component including a cylindrical opening within which said cylindrical plug is disposed, tumbler pin holes aligned with said tumbler pin holes formed in said cylindrical plug, and an auxiliary locking pin recess into which a portion of said auxiliary locking pin extends when said auxiliary locking pin is in its first position.

8. The lock according to claim 7, wherein said plug receiving component comprises a control sleeve and said cylindrical opening is defined by a hollow, cylindrical portion of said cylindrical sleeve, said cylindrical sleeve including a raised portion projecting radially from said cylindrical portion with said tumbler pin holes being formed in said raised portion, and wherein said lock further includes a shell including an first section and a second section, the first section having a hollow, generally cylindrical configuration and housing said control sleeve and said cylindrical plug, and the second section having a solid, generally cylindrical configuration and including a recess for receiving said raised portion of said control sleeve and tumbler pin holes aligned with said tumbler pin holes of said cylindrical plug and said control sleeve.

9. A lock system comprising the lock according to claim 1 and a key configured to be inserted into said keyway to position said tumbler pins so as to permit said cylindrical plug to rotate and to engage said slider to move said slider from its first position to its second position.

10. The lock system of claim 9, wherein said slider is disposed within a recess formed in said cylindrical plug adjacent said keyway and includes a contact surface projecting into said keyway and said key includes a key blade and a slider contact surface formed on said key blade for engaging said slider.

11. The lock according to claim 3, wherein said auxiliary pin spring surrounds at least a portion of the auxiliary locking pin.

12. The lock according to claim 1, wherein a center line of said auxiliary locking pin is laterally offset from a center line of at least one of said tumbler pin holes.

13. The lock according to claim 12, wherein the center lines of said tumbler pin holes are parallel and are aligned in a radial direction relative to said cylinder plug.

* * * * *